US008047534B2

(12) United States Patent
Sugiyama et al.

(10) Patent No.: US 8,047,534 B2
(45) Date of Patent: Nov. 1, 2011

(54) SHEET ACCOMMODATING DEVICE AND IMAGE RECORDING APPARATUS WITH A TRANSLATING PRESSING MEMBER ATTACHED TO A ROTATING TRAY COVER

(75) Inventors: Wataru Sugiyama, Aichi-ken (JP); Takashi Ohama, Iwakura (JP); Naokazu Tanahashi, Nagoya (JP); Noriyuki Kawamata, Nagoya (JP); Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 338 days.

(21) Appl. No.: 12/395,566

(22) Filed: Feb. 27, 2009

(65) Prior Publication Data

US 2009/0218754 A1 Sep. 3, 2009

(30) Foreign Application Priority Data

Feb. 29, 2008 (JP) ..... 2008-051362
Feb. 29, 2008 (JP) ..... 2008-051366

(51) Int. Cl.
*B65H 3/34* (2006.01)

(52) U.S. Cl. ..... 271/167; 271/3.03; 271/3.08; 271/902; 271/225; 271/185

(58) Field of Classification Search ..... None
See application file for complete search history.

(56) References Cited

U.S. PATENT DOCUMENTS

2005/0158111 A1* 7/2005 Yang ..... 400/624

FOREIGN PATENT DOCUMENTS

| | | | | |
|---|---|---|---|---|
| JP | S58-102254 | A | | 6/1983 |
| JP | 59167427 | A | * | 9/1984 |
| JP | 61095731 | U | * | 6/1986 |
| JP | S61-095731 | U | | 6/1986 |
| JP | 04182234 | A | * | 6/1992 |
| JP | H04-182234 | A | | 6/1992 |
| JP | H07-077854 | A | | 3/1995 |
| JP | H07-267381 | A | | 10/1995 |
| JP | H08-244995 | A | | 9/1996 |
| JP | H10-001236 | A | | 1/1998 |
| JP | 3092370 | U | | 12/2002 |

OTHER PUBLICATIONS

Oxford English Dictionary, "translate, v.", p. 3 of 7, http://www.oed.com/view/Entry/204841?rskey=jf3Ewz&result=2&isAdvanced=false.*

Japan Patent Office; Notification of Reason for Refusal in Japanese Patent Application No. 2008-051366 (counterpart to the above-captioned US Patent Application) mailed on Jun. 22, 2010.

Japan Patent Office; Notification of Reason for Refusal in Japanese Patent Application No. 2008-051362 (counterpart to the above-captioned US Patent Application) mailed on Jun. 8, 2010.

* cited by examiner

*Primary Examiner* — Gerald McClain
(74) *Attorney, Agent, or Firm* — Baker Botts L.L.P.

(57) ABSTRACT

A sheet accommodating device including: a tray configured to accommodate a sheet; and a pressing member configured to press the sheet accommodated in the tray, wherein the pressing member includes a guide portion configured to guide, where the sheet accommodated in the tray is transferred, the transferred sheet toward a downstream side in a sheet transferring direction in which the sheet is transferred.

14 Claims, 18 Drawing Sheets

SHEET ACCOMMODATING DEVICE AND IMAGE RECORDING APPARATUS WITH A TRANSLATING PRESSING MEMBER ATTACHED TO A ROTATING TRAY COVER

CROSS REFERENCE TO RELATED APPLICATION

The present application is based on Japanese Patent Application Nos. 2008-051366 filed on Feb. 29, 2008, and 2008-051362 filed on Feb. 29, 2008, the contents of which are incorporated herein by reference.

BACKGROUND OF THE INVENTION

1. Field of the Invention

The present invention relates to a sheet accommodating device and an image recording apparatus.

2. Description of the Related Art

There is conventionally known a sheet accommodating device including a pressing member attached to a tray cover configured to open and close an opening of a tray which accommodates recording sheets in a state that the recording sheets are stacked on each other. The pressing member presses the recording sheets in the tray in a state in which the tray cover closes the opening of the tray.

Relating to the sheet accommodating device of this type, Japanese Patent Application Publication No. 8-244995 discloses a sheet-supply tray 20. This sheet-supply tray 20 includes a tray body 21 which accommodates recording sheets P, and a tray cover 24 which is openably and closably attached to the tray body 21 and which can close a sheet loaded opening 23 of the tray body 21. Further, on the tray cover 24, there are provided a pair of plate springs 35, 35 which bias the recording sheets P accommodated in the tray body 21 toward a bottom plate 21*a* of the tray body 21.

Further, there is conventionally known an image recording apparatus in which a recording sheet is accommodated in a tray in a state in which the recording sheet is held by and interposed between a pair of side guides erected in the tray, and the recording sheet is contacted with a sheet-supply roller, so that an image is recorded on the recording sheet supplied by the sheet-supply roller.

Relating to the image recording apparatus of this type, Japanese Registered Utility Model No. 3092370 discloses an ink-jet printer for a one-sided recording operation, including a movable sheet guide 15 and a fixed sheet guide 11 which hold, therebetween, a recording sheet 16 accommodated in a sheet accommodating portion 8, and the recording sheet 16 accommodated in the sheet accommodating portion 8 is supplied by the sheet-supply roller 12, and an image is recorded on one of surfaces of the supplied recording sheet 16. Further, in this ink-jet printer for the one-sided recording operation, a projecting portion 15*e* is integrally formed in a sheet guide face 15*c* of the movable sheet guide 15 facing to the fixed sheet guide 11. The projecting portion 15*e* projects from the sheet guide face 15*c* toward the fixed sheet guide 11.

Thus, in this ink-jet printer for the one-sided recording operation, where the recording sheet 16 accommodated in the sheet accommodating portion 8 is transferred in a direction in which the recording sheet 16 is supplied (a direction indicated by arrow A) in order to record the image on the recording sheet 16, the recording sheet 16 can be guided toward the fixed sheet guide 11 by being brought into abutting contact with the projecting portion 15*e*.

SUMMARY OF THE INVENTION

In the above-described sheet-supply tray 20 of the sheet accommodating device, however, the pair of spring plates 35, 36 can prevent the recording sheets P from floating up by biasing the recording sheets P accommodated in the tray body 21, but each of the recording sheets P supplied from the tray body 21 may be transferred by biasing in an unexpected direction. Thus, supplying performance of the recording sheet may be, unstable unfortunately.

Further, in the ink-jet printer as described above, however, since the ink-jet printer is for the one-sided recording operation, there is no case in which the recording sheet 16 whose front surface has been subjected to an image recording operation is automatically retransferred to the sheet-supply roller 12. On the other hand, an assignee of the present invention proposes an image recording apparatus capable of a two-sided recording operation, in which a recording sheet whose front surface has been subjected to an image recording operation is automatically retransferred to a sheet-supply roller, and an image is also recorded on a back surface of the recording sheet. However, in this image recording apparatus capable of the two-sided recording operation, on a way of retransferring, to the sheet-supply roller, the recording sheet whose front surface has been subjected to an image recording operation, the recording sheet may be transferred obliquely due to a recording state of the front surface of the recording sheet, manufacturing variations in components, and so on. Thus, this image recording apparatus capable of the two-sided recording operation suffers from problems that the recording sheet does not reach the sheet-supply roller by deviating from a sheet-transfer path in which the recording sheet is to be transferred, and supplying performance of the recording sheet is not stabilized because a position at which the sheet-supply roller nips the recording sheet varies.

In order to solve these problems, in the sheet-transfer path in which the recording sheet whose front surface has been subjected to the image recording operation is transferred to the sheet-supply roller, a pair of side guides which hold the recording sheet therebetween may be provided using a technique disclosed by the above-described Japanese Registered Utility Model. However, in this case, a construction of the image recording apparatus becomes complicated unfortunately.

This invention has been developed in view of the above-described situations, and it is a first object of the present invention to provide a sheet accommodating device which can prevent floating-up of a recording sheet and can stabilize supplying performance of the recording sheet. Further, it is a second object of the present invention to provide an image recording apparatus which can correct, with a simple structure, oblique transferring of the recording sheet whose front surface has been subjected to an image recording operation, so as to stabilize resupplying performance of the recording sheet.

The first object indicated above may be achieved according to the present invention which provides a sheet accommodating device comprising: a tray configured to accommodate a sheet; and a pressing member configured to press the sheet accommodated in the tray, wherein the pressing member includes a guide portion configured to guide, where the sheet accommodated in the tray is transferred, the transferred sheet toward a downstream side in a sheet transferring direction in which the sheet is transferred.

The second object indicated above may be achieved according to the present invention which provides an image recording apparatus configured to record images on respective front and back surfaces of a sheet, comprising: a tray configured to accommodate the sheet; a pair of side guides provided so as to be erected in the tray, so as to extend along edge portions of the sheet accommodated in the tray which extend in a sheet transferring direction in which the sheet is transferred, and so as to respectively hold the edge portions of the sheet; a sheet-supply roller configured to supply the sheet accommodated in the tray and held by the pair of side guides; a recording device configured to record the image on the sheet supplied by the sheet-supply roller; and a sheet retransferring mechanism configured to retransfer a recorded sheet whose front surface has been subjected to image recording by the recording device, toward the sheet-supply roller through between the pair of side guides, wherein the pair of side guides respectively include a pair of side guide portions which respectively contact with the edge portions of the recorded sheet transferred toward the sheet-supply roller by the sheet retransferring mechanism, and between which the recorded sheet is transferred through, and wherein the pair of side guide portions are configured such that a distance therebetween in a widthwise direction of the sheet is larger than a width of the sheet at respective parts of the pair of side guide portions in the sheet transferring direction and is gradually decreased from the respective parts of the pair of side guide portions toward the sheet-supply roller.

In the sheet accommodating device constructed as described above, the sheet is prevented from floating up, and supplying performance of the sheet can be stabilized.

In the image recording apparatus constructed as described above, even where the sheet is transferred obliquely due to a recording state of the front surface of the sheet, manufacturing variation in components, and so on, the oblique transferring can be corrected by the pair of side guide portions. Further, since the pair of side guide portions are respectively provided integrally on the pair of side guides, there is no need to separately provide the pair of side guide portions and the pair of side guides. Thus, the image recording apparatus can correct, with a simple structure, oblique transferring of the sheet whose front surface has been subjected to the image recording and can stabilize resupplying performance of the sheet.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF EMBODIMENT

Figure 1:
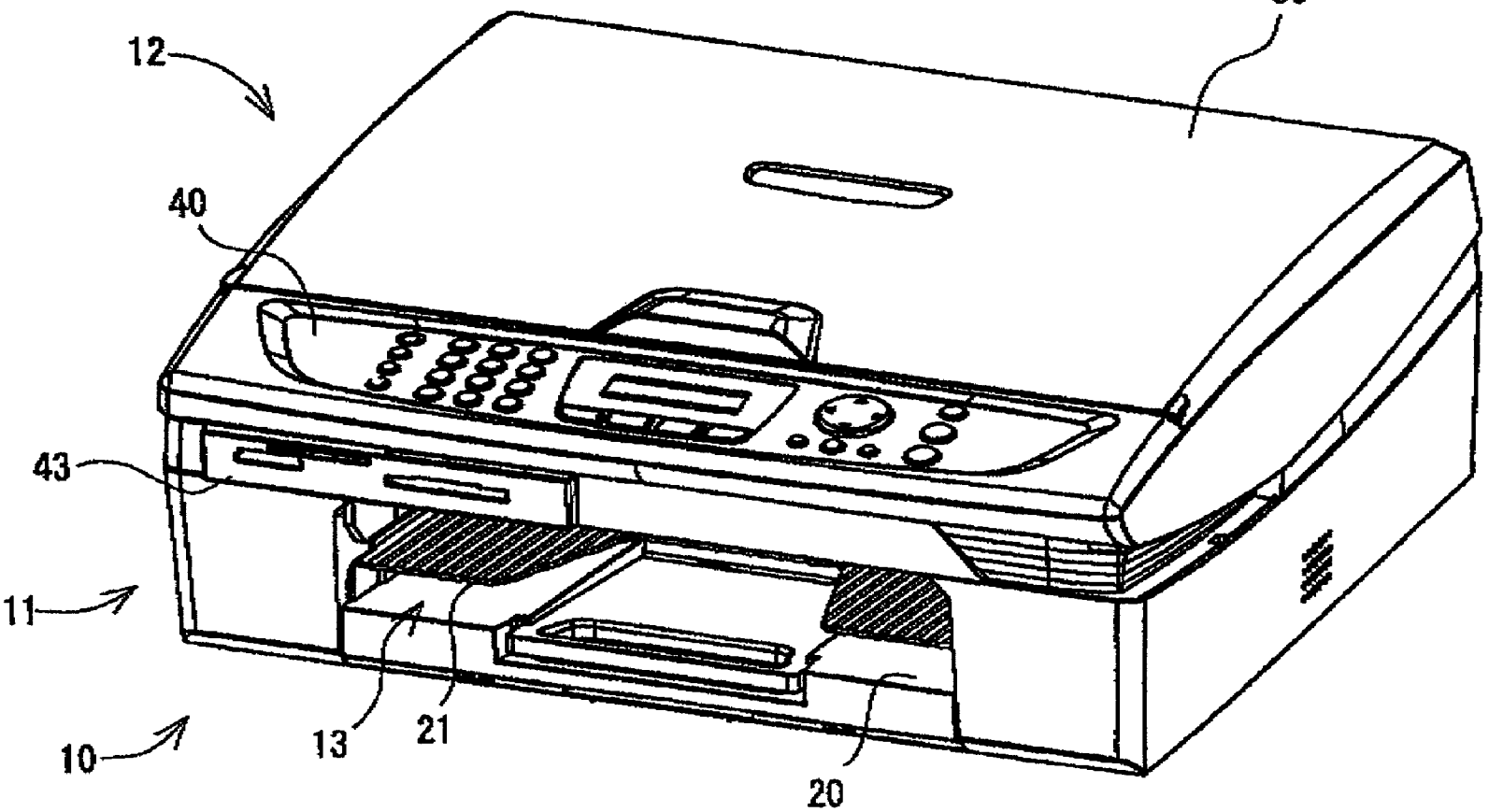
FIG. 1 is an external perspective view of an MFD as an embodiment of the present invention.

Hereinafter, there will be described an embodiment of the present invention by reference to the drawings.

A multi function device (MFD) 10 has various functions such as a telephone-conversation function, a facsimile function, a printing function, a scanning function, and a copying function. The printing function includes a two-sided printing function in which images are recorded on both sides of a recording sheet.

The MFD 10 includes a printer section 11 at its lower portion, a scanner section 12 at its upper portion, an operation panel 40 at its front upper portion, and a slot portion 43 at its front face.

An opening 13 is formed in a front face of the printer section 11. A sheet-supply tray 20 and a sheet-discharge tray 21 are provided in the printer section 11 so as to be superposed on each other in a vertical direction in a state in which portions of the sheet-supply tray 20 and the sheet-discharge tray 21 are exposed from the opening 13. The sheet-supply tray 20 can accommodate a plurality of recording sheets stacked on each other. The stacked recording sheets accommodated in the sheet-supply tray 20 are supplied, one by one, into the printer section 11. After a desired image is recorded on the front surface of each of the recording sheets, or desired images are recorded on the front and back surfaces of each recording sheet, each recorded recording sheet is discharged onto the sheet-discharge tray 21.

The scanner section 12 functions as what is called a flatbed scanner. A document cover 30 is provided as a top panel of the MFD 10. Under the document cover 30, a platen glass, not shown, is disposed. An original document is placed on the platen glass, and then read by the scanner 12 in a state in which the document is covered by the document cover 30.

The operation panel 40 is for operating the printer section 11 and the scanner section 12. The operation panel 40 includes various operational buttons and a liquid crystal display portion. A user can input, through the operation panel 40, commands for performing settings and operations of the various functions. For example, the user can input, through the operation panel 40, commands for performing a setting of a type of the recording sheet (i.e., a plain paper or a postcard), a setting of a one-sided recording mode (operation) in which the image is recorded only on the front surface of the recording sheet, a setting of a two-sided recording mode (operation) in which the images are recorded on the front and back surfaces of the recording sheet, and a setting of a resolution (i.e., a setting for selecting a draft mode or a photo mode).

Various small-sized memory cards each as a storage medium can be mounted into the slot portion 43. For example, image data stored in one of the memory cards can be read by an operation of the user in a state in which the memory card is mounted in the slot portion 43. Thus, the image or images can be recorded on the recording sheet on the basis of the read image data.

Figure 2:
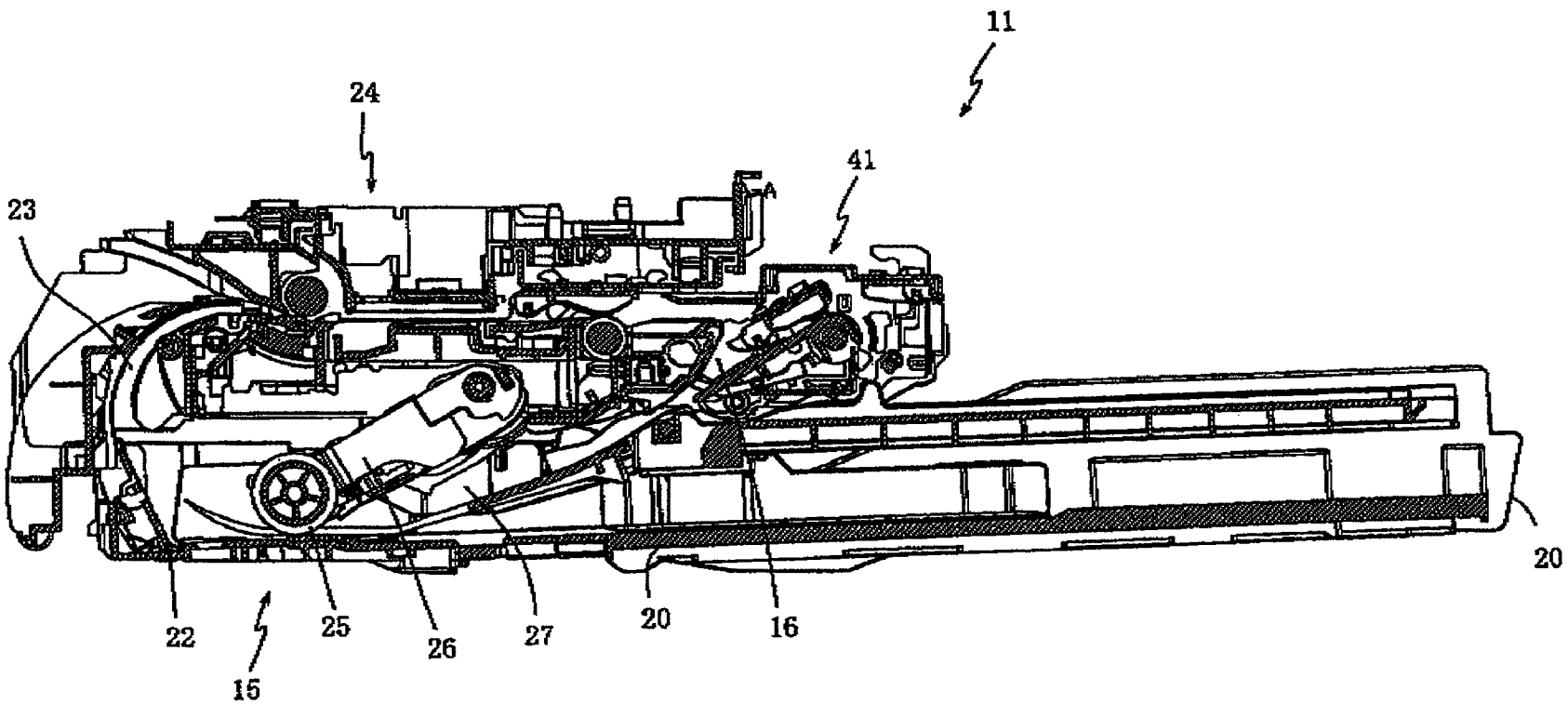
FIG. 2 is an elevational view showing a structure of a printer section of the MFD in vertical cross section.

There will be next explained a structure of the printer section 11 with reference to FIG. 2. The printer section 11 mainly includes a sheet-supply portion 15, a sheet-transfer path 23, a recording portion 24 as a recording device, the sheet-discharge tray 21, a path-switching member 41, and a sheet-return path 16. The sheet-supply portion 15 is for supplying each recording sheet to the sheet-transfer path 23. The recording sheet supplied from the sheet-supply portion 15 is transferred through the sheet-transfer path 23. The recording portion 24 records, by ejecting ink as ink droplets, the image or images on each recording sheet transferred through the sheet-transfer path 23. Each recording sheet on which the image or images is or are recorded is discharged onto the sheet-discharge tray 21. The path-switching member 41 is provided between the sheet-discharge tray 21 and the recording portion 24 and is for switching routes through which the recording sheet is transferred, in order to record the image on the back surface of the recording sheet. The sheet-return path 16 is for guiding the recording sheet which is transferred through a selected one of the routes, toward the sheet-supply portion 15 and the sheet-transfer path 23.

The sheet-supply tray 20 which can accommodate the plurality of recording sheets is provided in the sheet-supply portion 15. The sheet-supply tray 20 is disposed in a bottom portion of the printer section 11 and has a box-like shape opening upward. Each of the recording sheets stacked on the sheet-supply tray 20 is supplied to the sheet-transfer path 23 by a sheet-supply roller 25.

When the image is recorded (that is, an image recording operation is performed) only on the front surface of the recording sheet, that is, the one-sided recording operation is performed, the recording sheet supplied by the sheet-supply roller 25 is guided along the sheet-transfer path 23 so as to make an upward U-turn, and then reaches the recording portion 24. After the image is recorded on the front surface of the recording sheet by the recording portion 24, the recorded recording sheet is discharged onto the sheet-discharge tray 21.

When the images are recorded on the front and back surfaces of the recording sheet (that is, the image recording operation is performed on each of the front and back surfaces), that is, the two-sided recording operation is performed, a recording sheet (recorded recording sheet) whose front surface has been subjected to the image recording operation is guided by the path-switching member 41 to the sheet-return path 16 such that the front surface of the recording sheet is to be brought into contact with the sheet-supply roller 25. Then, the sheet-supply roller 25 supplies the recording sheet to the sheet-transfer path 23 again. After the image is recorded on the back surface of the recording sheet by the recording portion 24, the recorded recording sheet is discharged onto the sheet-discharge tray 21.

Figure 3:
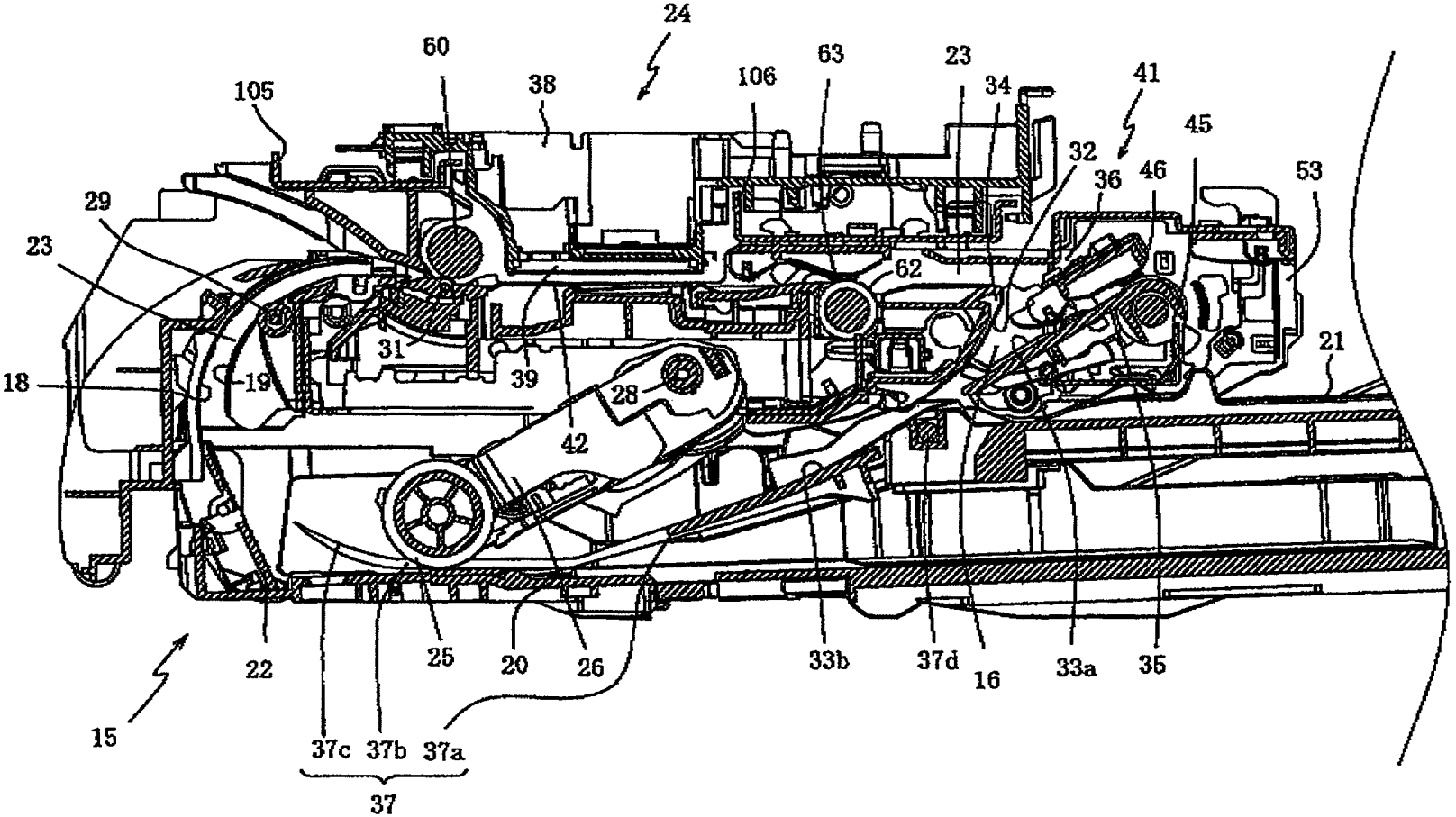
FIG. 3 is an enlarged cross-sectional view partly showing the printer section.

There will be next explained a structure of the printer section 11 with reference to FIG. 3 in detail. In the sheet-supply portion 15, the sheet-supply roller 25 is disposed on the sheet-supply tray 20. The sheet-supply roller 25 contacts with an uppermost one of the recording sheets stacked on the sheet-supply tray 20 so as to transfer the uppermost recording sheet for supplying the uppermost recording sheet to the sheet-transfer path 23. The sheet-supply roller 25 is rotatably supported at a distal end of a sheet-supply arm 26. The sheet-supply roller 25 is driven to be rotated by an LF motor 71 (shown in FIG. 13) as a drive source thereof via a drive-power transmitting mechanism 27. The drive-power transmitting mechanism 27 includes a plurality of gears which are linearly arranged and each of which is meshed with an adjacent one or ones of the gears.

The sheet-supply arm 26 is supported at a proximal end thereof by a pivotal shaft 28 so as to be pivotable about the pivotal shaft 28 defining a pivotal axis. Thus, the sheet-supply arm 26 is pivotable upward and downward so as to move toward and away from the sheet-supply tray 20. The sheet-supply arm 26 is forced so as to pivot downward by a self-weight thereof or by a force of a spring or the like. Thus, the sheet-supply arm 26 normally contacts with the sheet-supply tray 20, and when the sheet-supply tray 20 is inserted into and pulled out of the MFD 10, the sheet-supply arm 26 is retracted to an upper position thereof.

When the recording sheet is supplied from the sheet-supply tray 20, the sheet-supply roller 25 is rotated in a state in which the sheet-supply roller 25 is held in pressing contact with the uppermost one of the recording sheets on the sheet-supply tray 20, with the sheet-supply arm 26 forced so as to pivot downward. Then, the uppermost recording sheet is transferred toward a slant sheet separator plate 22 owing to a friction force between a roller surface of the sheet-supply roller 26 and the recording sheet.

When the transferred recording sheet abuts at its leading end on the slant sheet separator plate 22, the transferred recording sheet is guided upward so as to be transferred into the sheet-transfer path 23. When the uppermost recording sheet is transferred by the sheet-supply roller 25, the recording sheet immediately below the uppermost recording sheet may be transferred together with the uppermost recording sheet by friction or static electricity. However, the recording sheet transferred together with the uppermost recording sheet is prevented from being transferred by abutting contact with the slant sheet separator plate 22.

The sheet-transfer path 23 extends upward from the slant sheet separator plate 22, and then extends from a back side toward a front side (i.e., a right side of FIG. 3) of the MFD 10 while making a U-turn in a lateral direction. Then, the sheet-transfer path 23 finally reaches the sheet-discharge tray 21 via the recording portion 24.

The sheet-transfer path 23 is defined by an outer guide face and an inner guide face, except a portion thereof where the image recording portion 24 and so on are disposed. For example, a curved portion of the sheet-transfer path 23 which is located nearer to the back side of the MFD 10 is defined by an outer guide member 18 and an inner guide member 19 which are disposed so as to face each other with a prescribed, distance interposed therebetween.

It is noted that rotatable guide rollers 29 are provided at the curved portion of the sheet-transfer path 23. Roller surfaces of the respective guide rollers 29 are exposed from the inner guide member 19. Thus, the guide rollers 29 assure smooth transferring of the recording sheet at the curved portion of the sheet-transfer path 23.

A register sensor 102 (shown in FIG. 13) is disposed on an upstream side of a sheet-feed roller 60 in the sheet-transfer path 23. The register sensor 102 includes a detecting piece and an optical sensor. The detecting piece is disposed across the sheet-transfer path 23 and can project into and retract from the sheet-transfer path 23. Normally, the detecting piece is elastically forced so as to project into the sheet-transfer path 23. Each recording sheet being transferred in the sheet-transfer path 23 is brought into contact with the detecting piece, whereby the detecting piece retracts from the sheet-transfer path 23. The projection and retraction of the detecting piece change an "ON" state and an "OFF" state of the optical sensor. Thus, each recording sheet causes the detecting piece to project and retract, whereby the leading end and a trailing end of each recording sheet in the sheet-transfer path 23 are detected.

The recording portion 24 is disposed in the sheet-transfer path 23 and includes a carriage 38 and a recording head 39. The recording head 39 is mounted on the carriage 38 and is reciprocated along guide rails 105, 106 in a main scanning direction (in a direction perpendicular to the sheet surface of FIG. 3).

Specifically, the carriage 38 is slid by a CR motor 95 (shown in FIG. 13) as a drive source thereof via a belt driving mechanism, for example. It is noted that ink cartridges, not shown, are disposed in the MFD 10, independently of the recording head 39. Ink is supplied from the ink cartridges to the recording head 39 via respective ink tubes. Then, while the carriage 38 is reciprocated, the ink is ejected as fine ink droplets from the recording head 39. Thus, the images are recorded on the recording sheet transferred on a platen 42.

On a frame 53 of the MFD 10, there is provided a linear encoder 85 (shown in FIG. 13) for detecting a position of the carriage 88. An encoder strip of the linear encoder 85 is disposed on the guide rails 105, 106. The encoder strip includes light transmitting portions each of which transmits light and light intercepting portions each of which intercepts light. The light transmitting portions and the light intercepting portions are alternately arranged at predetermined pitches in a longitudinal direction of the encoder strip so as to form a predetermined pattern.

An optical sensor of a transmission type is provided on an upper surface of the carriage 38. The optical sensor is provided at a position corresponding to the encoder strip. The optical sensor reciprocates together with the carriage 38 in the longitudinal direction of the encoder strip. During the reciprocation, the optical sensor detects the pattern of the encoder strip.

On the carriage 38, there is provided a media sensor 86 (shown in FIG. 13) for detecting presence and absence of the recording sheet on the platen 42. The media sensor 86 includes a light-emitting device and a light-receiving element. Light emitted from the light-emitting device is radiated to the recording sheet transferred on the platen 42. Where the recording sheet is not transferred onto the platen 42, the light is radiated to the platen 42. The light radiated to the recording sheet or the platen 42 is reflected, and the reflected light is received by the light-receiving element. The media sensor 86 outputs a signal according to an amount of the received light.

On an upstream side of the recording portion 24 in the sheet-transfer path 23, the sheet-feed roller 60 and a pinch roller 31 are provided as a pair. The sheet-feed roller 60 and the pinch roller 31 are for feeding each recording sheet transferred in sheet-transfer path 23, onto the platen 42 while nipping each recording sheet. The pinch roller 31 is disposed so as to be held in pressing contact with a lower portion of the sheet-feed roller 60. A position at which the pinch roller 31 is held in pressing contact with the lower portion of the sheet-feed roller 60 is located above the platen 42.

On a downstream side of the recording portion 24 in the sheet-transfer path 23, a sheet-discharge roller 62 and spur rollers 63 are provided. The sheet-discharge roller 62 and the spur rollers 63 are for transferring each recorded recording sheet, while nipping each recorded recording sheet, toward a downstream side of the MFD 10 through the sheet-transfer path 23 in a direction along the sheet-transfer path 23 (hereinafter may be referred to as a sheet transferring direction).

The sheet-feed roller 60 and the sheet-discharge roller 62 are driven by the LF motor 71 as drive sources thereof. The sheet-feed roller 60 and the sheet-discharge roller 62 are driven so as to be synchronized with each other and intermittently driven during the image recording operation. Thus, the image recording operation is performed while each recording sheet is fed at a suitable line feed pitch.

Figure 13:
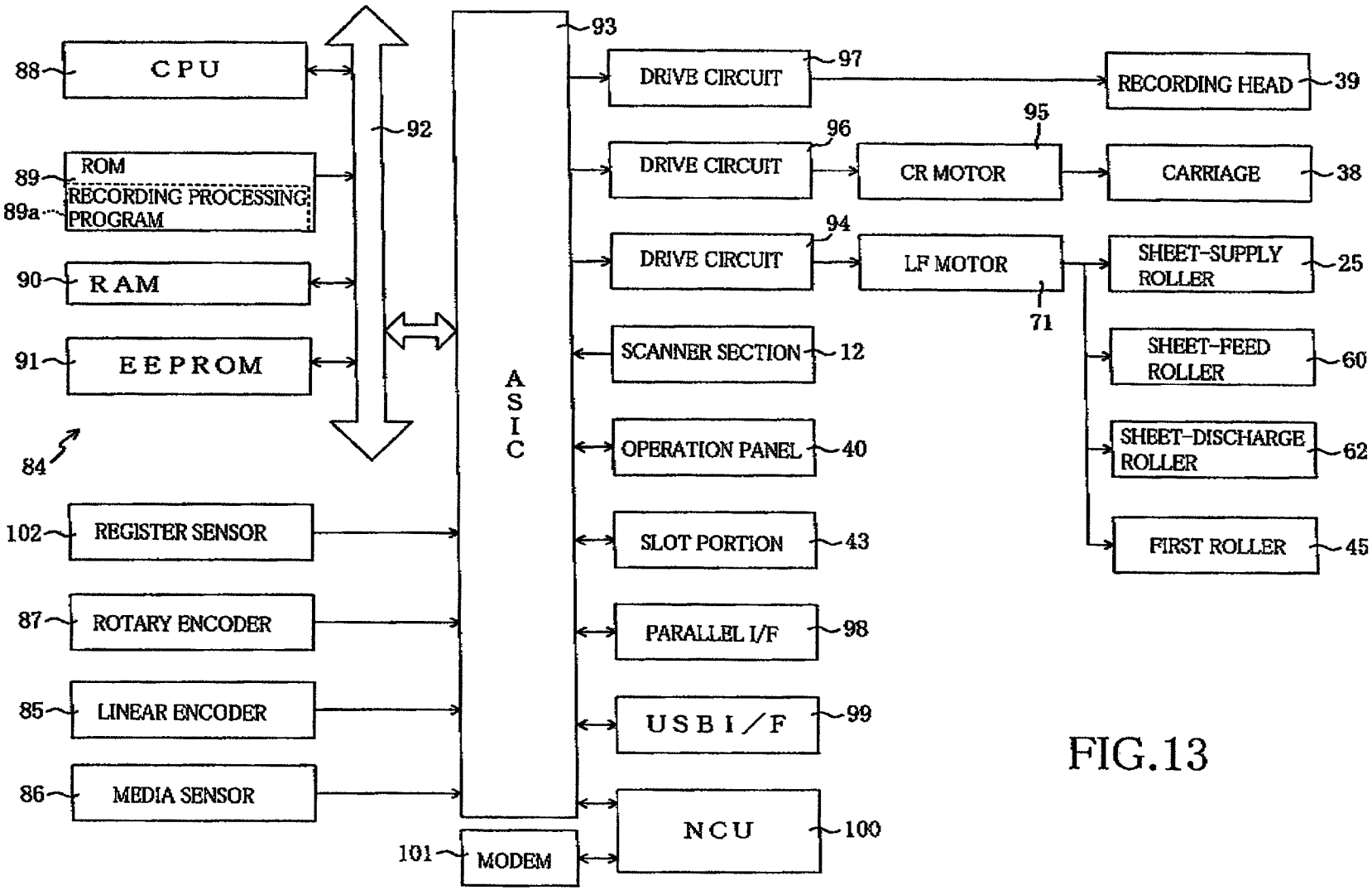
FIG. 13 is a block diagram showing a configuration of a controller of the MFD.

It is noted that the sheet-feed roller 60 is provided with a rotary encoder 87 (shown in FIG. 13). The rotary encoder 87 detects, by an optical sensor, a pattern of an encoder disk (not shown) which is rotated together with the sheet-feed roller 60. On the basis of signals detected by the optical sensor, respective rotations of the sheet-feed roller 60 and the sheet-discharge roller 62 are controlled. Before and after the image recording operation, the sheet-feed roller 60 and the sheet-discharge roller 62 are constantly driven, thereby realizing a speedy transferring of each recording sheet.

The spur rollers 63 are brought into pressing contact with each recorded recording sheet. A roller surface of each of the spur rollers 63 has a plurality of projections and depressions like a spur so as not to deteriorate the image recorded on the recording sheet. The spur rollers 63 are provided so as to be slidable and movable toward and away from the sheet-discharge roller 62. The spur rollers 63 are forced so as to be brought into pressing contact with the sheet-discharge roller 62. It is noted that coil springs are typically employed as means for forcing the spur rollers 63 to the sheet-discharge roller 62.

Although not shown in FIG. 3, in this MFD 10, the spur rollers 63 are arranged so as to be equally spaced in a direction perpendicular to the sheet transferring direction, that is, in a widthwise direction of each recording sheet. The number of the spur rollers 63 is not particularly limited, but this MFD 10 includes eight spur rollers 63.

When each recording sheet is transferred into between the sheet-discharge roller 62 and the spur rollers 63, the spur rollers 63 are retracted against forces of coil springs by a distance corresponding to a thickness of the recording sheet. Each recording sheet is pressed onto the sheet-discharge roller 62. Thus, a rotational force of the sheet-discharge roller 62 is reliably transmitted to each recording sheet. The pinch roller 31 is elastically forced to the sheet-feed roller 60 in a similar manner. Thus, each recording sheet is pressed onto the sheet-feed roller 60, whereby a rotational force of the sheet-feed roller 60 is reliably transmitted to each recording sheet.

Figure 4:
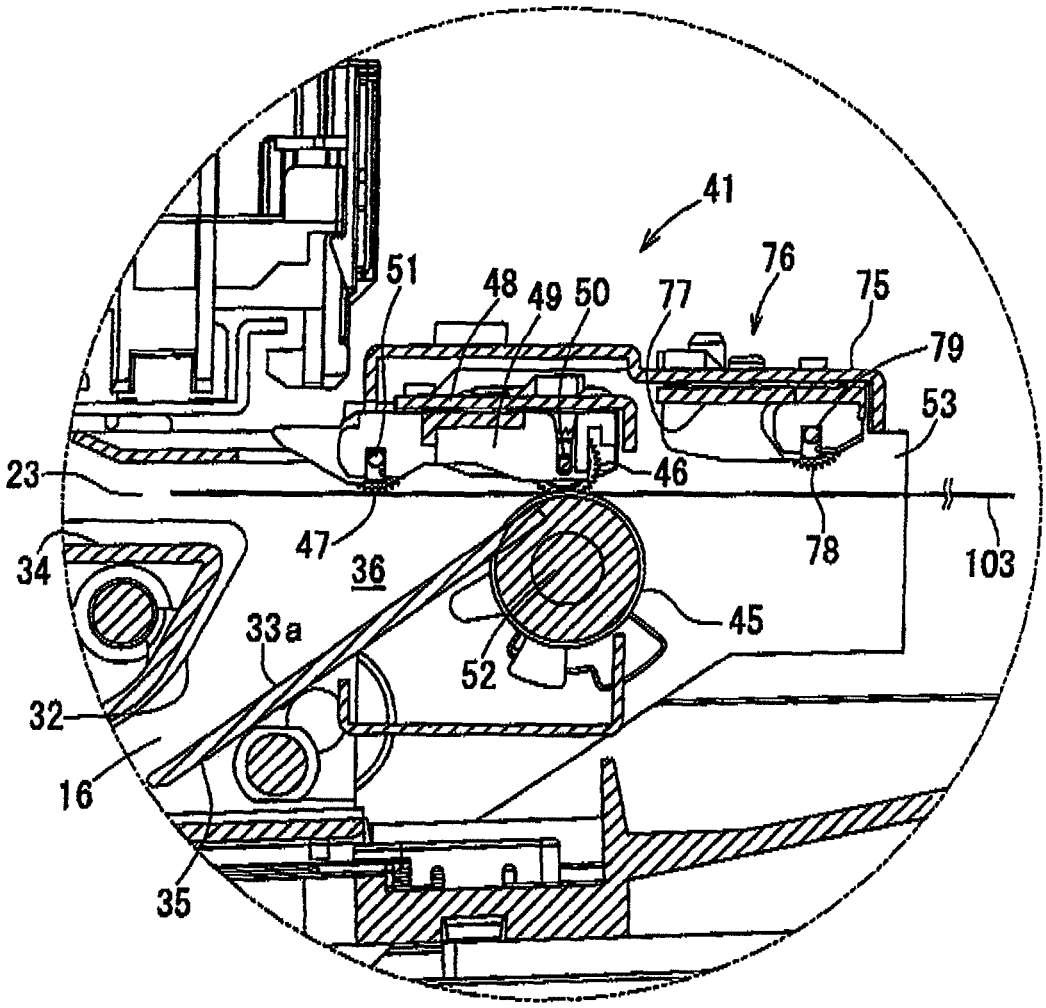
FIG. 4 is an enlarged cross sectional view showing a part of the MFD which includes the path-switching member, in a state in which the path-switching member takes a recording sheet discharged posture.
Figure 5:
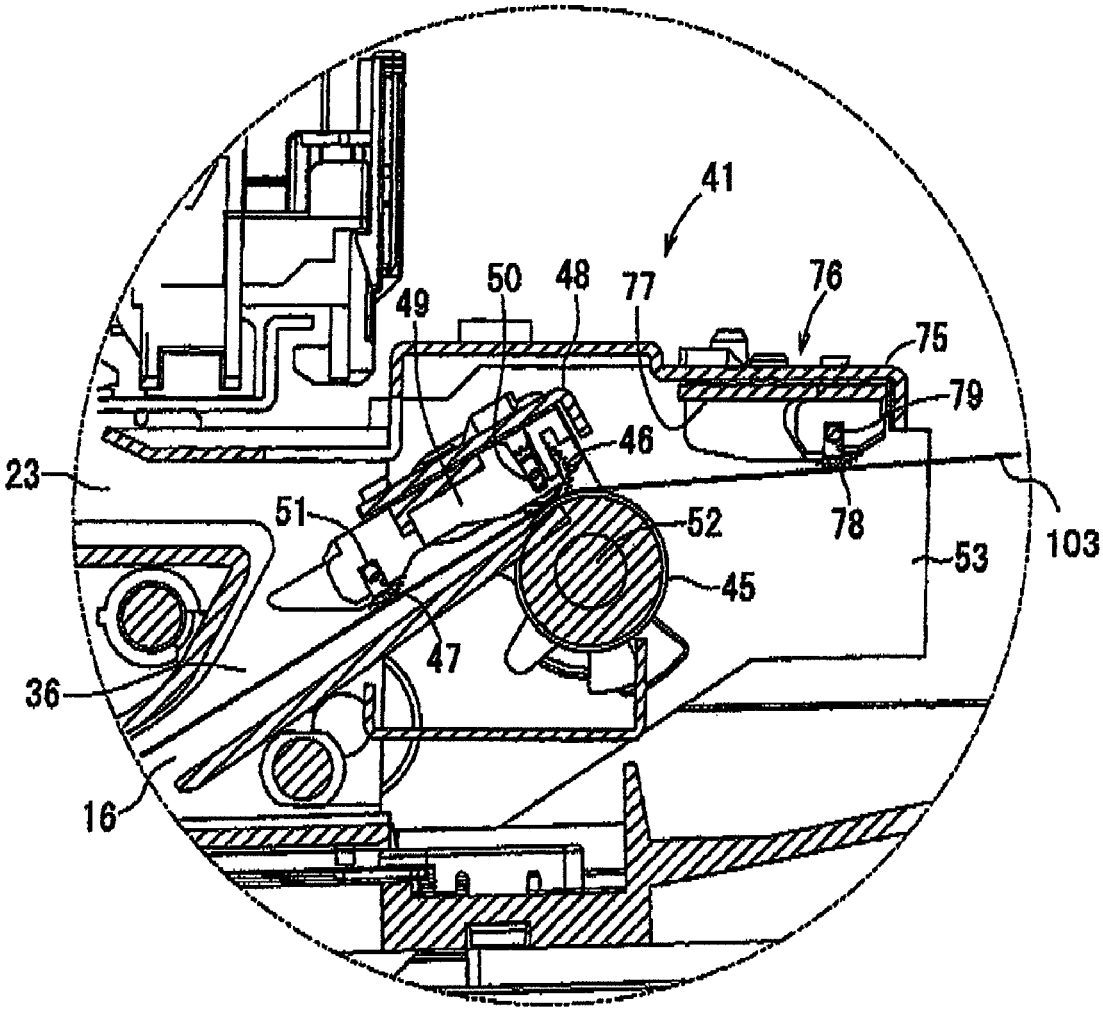
FIG. 5 is an enlarged cross sectional view of the part of the MFD which includes the path-switching member, in a state in which the path-switching member takes a recording sheet reversed posture.

There will be next explained the path-switching member 41 with reference to FIGS. 4 and 5. The path-switching member 41 is disposed on a downstream side of the recording portion 24, the sheet-discharge roller 62, and the spur roller 63 in the sheet transferring direction. More specifically, the path-switching member 41 is disposed in a downstream portion 36 of the sheet-transfer path 23 which is located downstream of the recording portion 24, that is, the path-switching member 41 is disposed on an downstream side, in the sheet transferring direction, of a boundary portion between the sheet-transfer path 23 and the sheet-return path 16. The path-switching member 41 is provided with a first roller 45 and second rollers 46 as a pair of sheet-transfer rollers, and auxiliary rollers 47 each of which is provided on a side of a corresponding one of the second rollers 46.

The first roller 45 and the second rollers 46 transfer a recording sheet 103 passed or transferred through the recording head 39 by the sheet-discharge roller 62 and the spur rollers 63 while nipping the recording sheet 103. The first roller 45 and the second rollers 46 can transfer the recording sheet 103 in the sheet-transfer path 23 to a further downstream side in the sheet transferring direction (that is, toward the sheet-discharge tray 21 and an outside of the MFD 10). Further, the first roller 45 and the second rollers 46 can transfer the recording sheet 103 to the sheet-return path 16 and to the sheet-supply roller 25 such that the recording sheet 103 is permitted to be again supplied to the recording head 39 by the sheet-supply roller 25.

Figure 6:
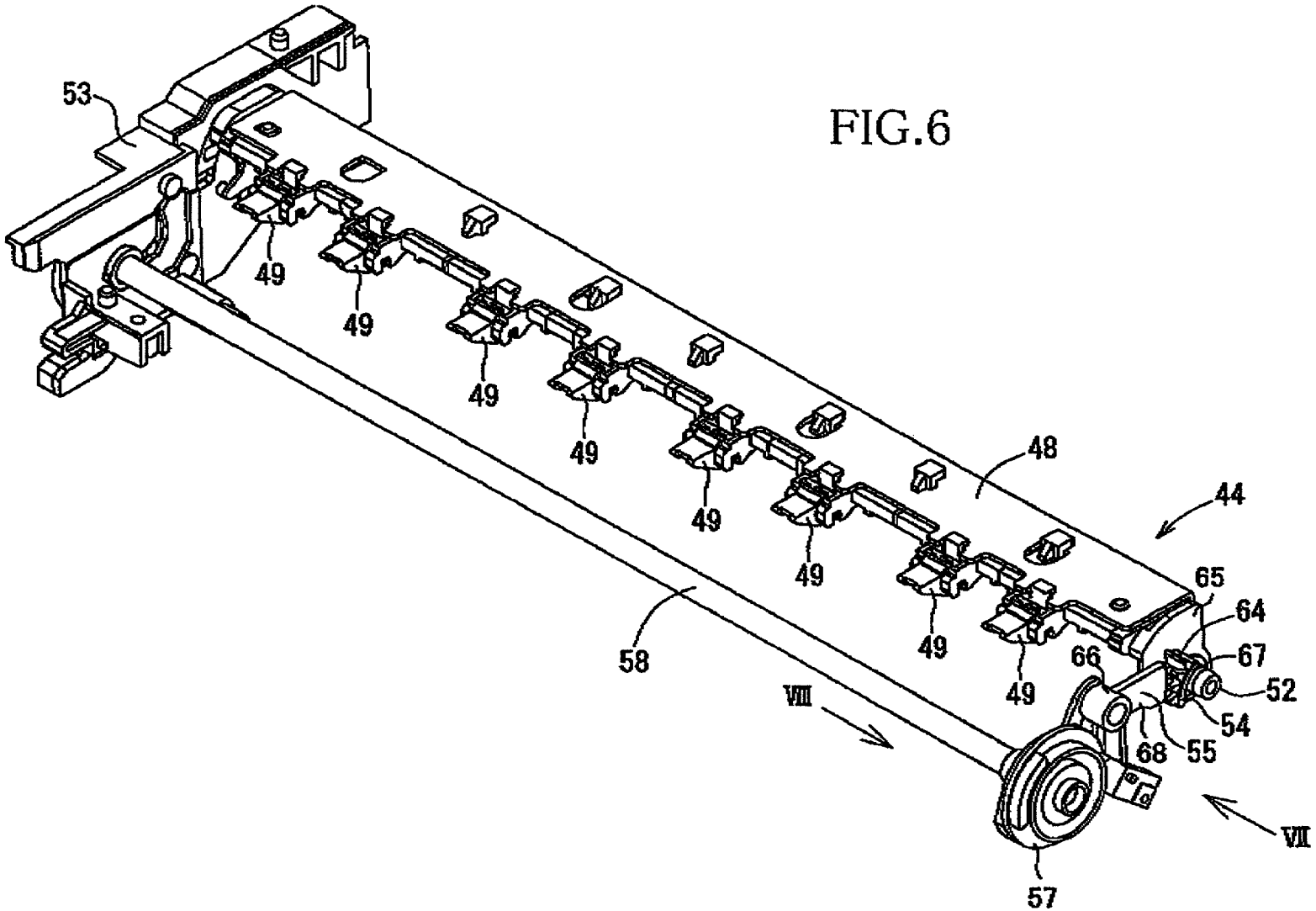
FIG. 6 is a perspective view of the path-switching member.

The second rollers 46 and the auxiliary rollers 47 are attached to a frame 48. As shown in FIG. 6, the frame 48 extends in a right and left direction of the MFD 10 (in a direction perpendicular to a sheet surface of FIG. 3). The frame 48 has a generally-L-shaped cross section, thereby assuring a required flexural rigidity of the frame 48.

The frame 48 includes eight sub-frames 49 (shown in FIG. 6) formed integrally with the frame 48. The sub-frames 49 are arranged so as to be symmetric with respect to a center of the MFD 10 in the right and left direction. Each of the sub-frames 49 supports a corresponding one of the second rollers 46 and a corresponding one of the auxiliary rollers 47. Consequently, the frame 48 includes the eight second rollers 46 and the eight auxiliary rollers 47. The second rollers 46 and the auxiliary rollers 47 are arranged so as to be equally spaced in the direction perpendicular to the sheet transferring direction, that is, in a widthwise direction of the recording sheet 103.

The sub-frames 49 are provided with support shafts 50, 51. The second rollers 46 are supported by the support shaft 50 so as to be rotatable about the support shaft 50. The auxiliary rollers 47 are supported by the support shaft 51 so as to be rotatable about the support shaft 51. In this MFD 10, each of the second rollers 46 and the auxiliary rollers 47 is provided by a spur roller. The auxiliary rollers 47 are disposed on an upstream side of the second rollers 46 in the sheet transferring direction by a specific distance. The second rollers 46 are forced downward by springs, not shown, so as to be normally and elastically pressed onto the first roller 45.

The first roller 45 is linked to the LF motor 71 (shown in FIG. 13) via a drive-power transmitting mechanism so as to be driven to be rotated by drive power of the LF motor 71. The first roller 45 has a central shaft 52. The central shaft 52 is supported by the frame 53.

The second rollers 46 are disposed on an upper side of the first roller 45. The first roller 45 may have an elongated cylindrical shape and may be provided by eight rollers respectively opposed to the second rollers 46.

It is noted that the first roller 45 is forwardly and reversely rotated by the LF motor 71 so as to transfer each recording sheet 103 toward the sheet-discharge tray 21 or toward the sheet-return path 16. That is, the recording sheet 103 transferred in the sheet-transfer path 23 is nipped by the first roller 45 and the second rollers 46. Then, when the first roller 45 is forwardly rotated, the recording sheet 103 is transferred downstream in the sheet transferring direction while being nipped by the first roller 45 and the second rollers 46, and then the recording sheet 103 is discharged onto the sheet-discharge tray 21. When the first roller 45 is reversely rotated, the recording sheet 103 is transferred or returned upstream in the sheet transferring direction while being nipped by the first roller 45 and the second rollers 46.

In this MFD 10, an outer diameter of the first roller 45 is set to be slightly larger than that of the sheet-discharge roller 62. That is, when the first roller 45 and the sheet-discharge roller 62 are rotated at the same rotational speed, a peripheral speed of the first roller 46 is faster than that of the sheet-discharge roller 62. Thus, when the recording sheet 103 is transferred by both of the sheet-discharge roller 62 and the first roller 45, the recording sheet 103 is normally tensioned in the sheet transferring direction.

In view of the above, the path-switching member 41, the first roller 45, the second rollers 46, and auxiliary rollers 47 constitute a sheet retransferring mechanism configured to retransfer, toward the sheet-supply roller 25, the sheet whose front surface has been subjected to image recording operation.

Here, there will be explained a drive mechanism 44 of the path-switching member 41 with reference to FIGS. 6 to 8. The drive mechanism 44 is for driving the path-switching member 41 to change from a state shown in FIG. 4 to a state shown in FIG. 5, and for driving the path-switching member 41 to return from the state shown in FIG. 5 to the state shown in FIG. 4.

As shown in FIG. 6, the drive mechanism 44 includes a driven gear 54 provided on the central shaft 52, a drive gear 55 meshable with the driven gear 54, and a cam 57 engaging the drive gear 55.

The cam 57 is connected to one of opposite ends of a rotation driving shaft 58. The rotation driving shaft 58 is driven by the drive power of the LF motor 71. As shown in FIG. 8, a guide groove 59 is formed in the cam 57. The guide groove 59 is generally annular about the rotation driving shaft 58. Specifically, the guide groove 59 has a small arc portion 69, a large arc portion 70, a connecting portion 72, and a connecting portion 73. The small arc portion 69 and the large arc portion 70 are centered about the rotation driving shaft 58. The connecting portion 72 connects one end of the small arc portion 69 and one end of the large arc portion 70. The connecting portion 73 connects the other end of the small arc portion 69 and the other end of the large arc portion 70.

Figure 7:
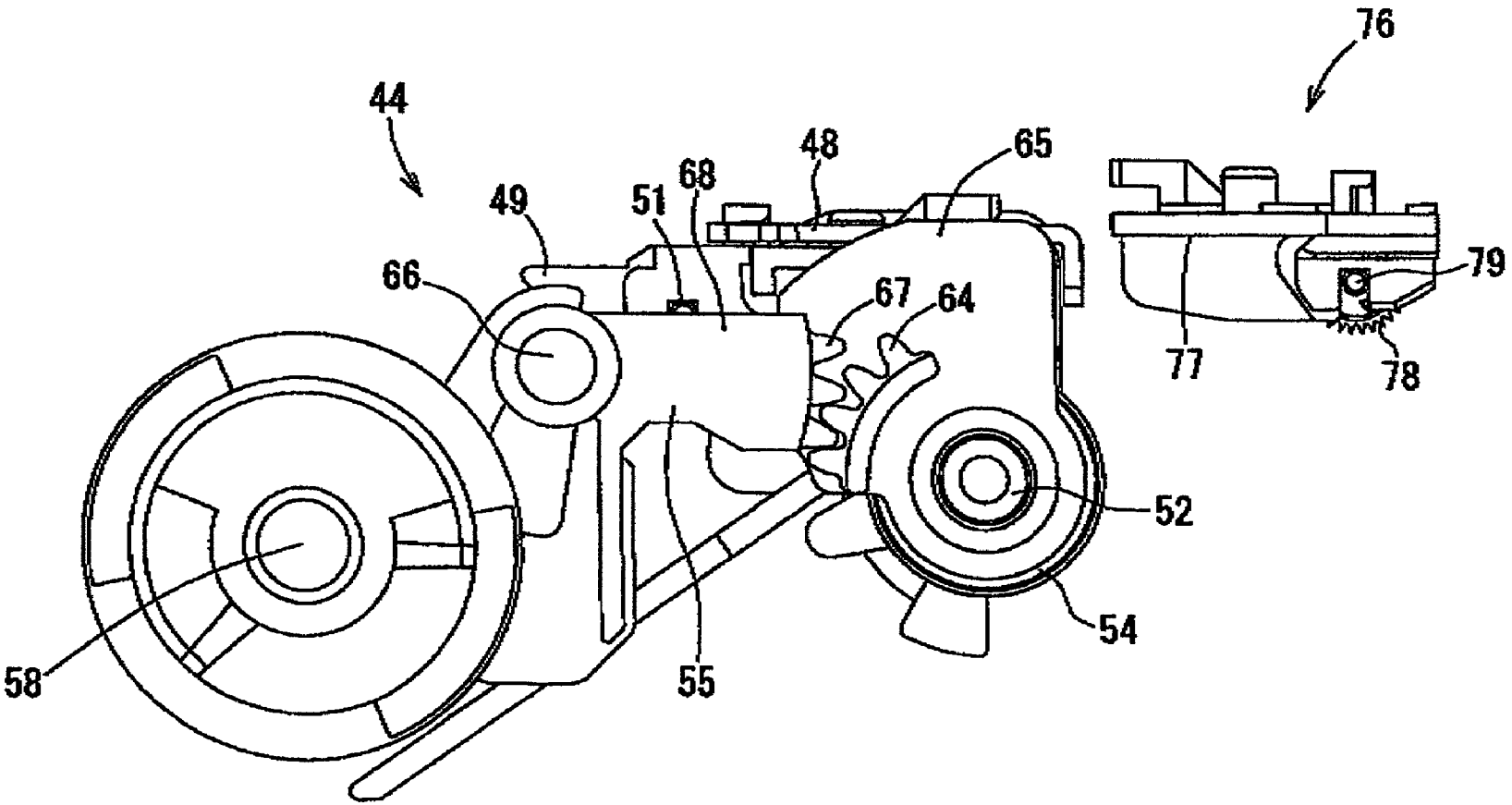
FIG. 7 is a view of the path-switching member as viewed in a direction indicated by arrow VII in FIG. 6.

As shown in FIGS. 6 and 7, the driven gear 54 includes a toothed portion 64 and a flange portion 65. The toothed portion 64 is provided as an involute gear centered about the central shaft 52. The toothed portion 64 is fitted on the central shaft 52 so as to be rotatable about the central shaft 52. The flange portion 65 is formed integrally with the toothed portion 64 and connected to the frame 48. Thus, when the toothed portion 64 is rotated, the frame 48, the sub-frames 49, the second rollers 46, and the auxiliary rollers 47 are rotated together about the central shaft 52.

The drive gear 55 is rotatably supported by a support shaft 66. The support shaft 66 is provided on the frame 53. The drive gear 55 includes a toothed portion 67 and an arm 68. The toothed portion 67 is provided as an involute gear centered about the support shaft 66 and meshed with the toothed portion 64. A pin 56 shown in FIG. 8 is provided on the arm 68 so as to be projected from the arm 68. The pin 56 is fitted in the guide groove 59 so as to be slidable along the guide groove 59. A rotation of the toothed portion 67 causes the toothed portion 64 to be rotated. As a result, the frame 48, the sub-frames 49, the second rollers 46, and the auxiliary rollers 47 are rotated together about the central shaft 52.

Figure 8:
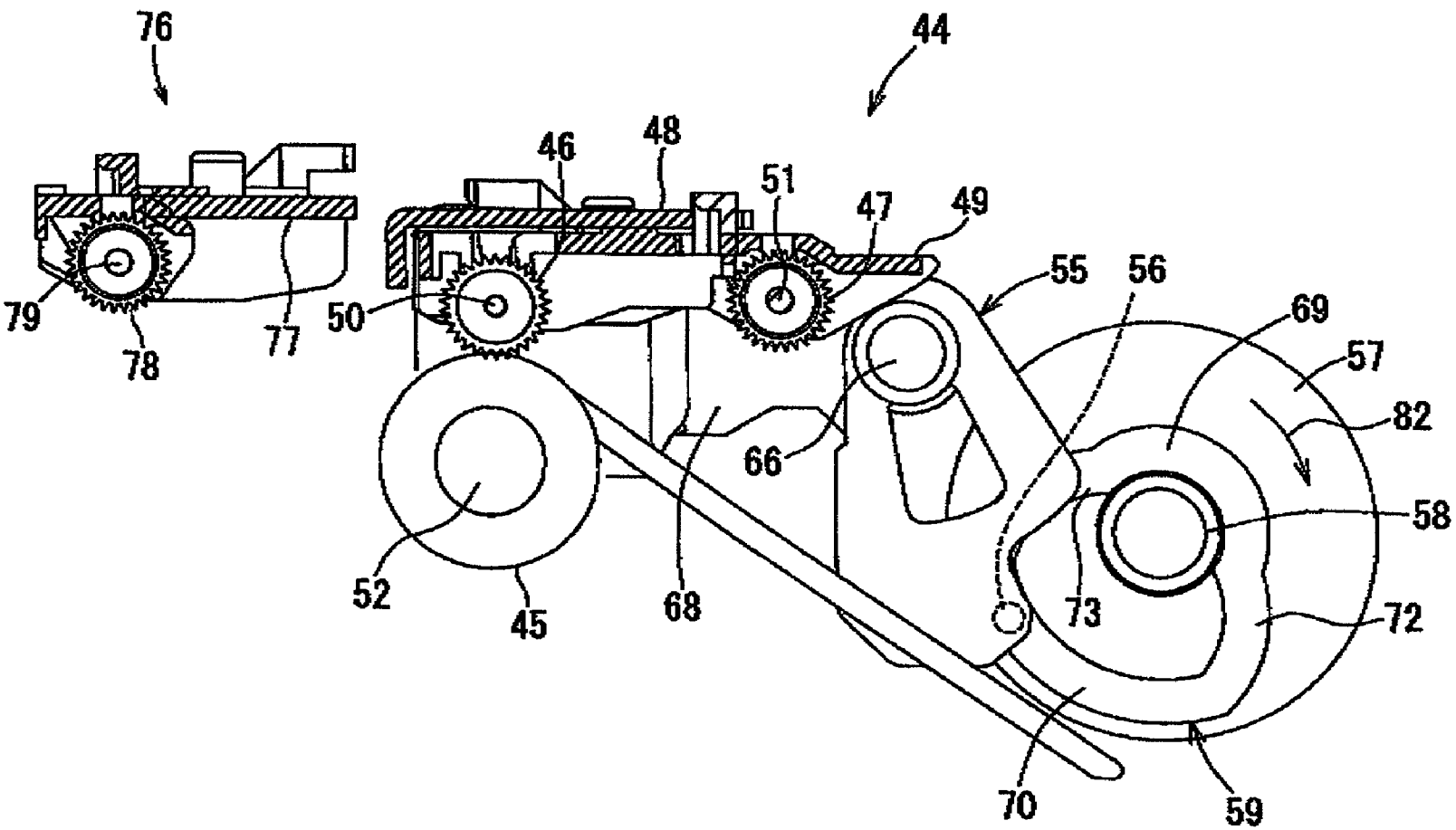
FIG. 8 is a view of the path-switching member as viewed in a direction indicated by arrow VIII in FIG. 6.

As shown in FIG. 8, when the cam 57 is rotated, the pin 56 is moved relative to the cam 57 along the guide groove 59. In particular, when the pin 56 is slid along the connecting grooves 72, 73, the pin 56 is moved in a radial direction of the cam 57. Thus, when the cam 57 is rotated in a clockwise direction indicated by arrow 82 in FIG. 8, the pin 56 is moved to the large arc portion 70, the connecting portion 72, and the small arc portion 69 in order.

Thus, the drive gear 55 is rotated in the clockwise direction in FIG. 7. As a result, the driven gear 54 is rotated about the central shaft 52 in the counterclockwise direction in FIG. 7. As described above, the driven gear 54 is connected to the frame 48. Thus, a rotation of the driven gear 54 causes the frame 48, the sub-frames 49, the second rollers 46, and the auxiliary rollers 47 to be rotated together about the central shaft 52 as shown in FIG. 5. It is noted that, in this state, when the cam 57 is rotated in the counterclockwise direction, the frame 48, the subframes 49, the second rollers 46, and the auxiliary rollers 47 are rotated together with each other about the central shaft 52 so as to return to their original state as shown in FIG. 4.

In this MFD 10, a posture of the path-switching member 41 shown in FIG. 4 is referred to as a recording sheet discharged posture while a posture of the path-switching member 41 shown in FIG. 5 is referred to as a recording sheet reversed posture. When only the front surface of the recording sheet is subjected to the image recording operation (that is, the one-sided recording operation is performed), the path-switching member 41 always takes the recording sheet discharged posture as shown in FIG. 4, and each recording sheet transferred in the sheet-transfer path 23 is transferred toward the sheet-discharge tray 21.

As shown in FIG. 5, when the path-switching member 41 is changed to the recording sheet reversed posture, the recording sheet 103 is guided to the sheet-return path 16. More specifically, when each of the front and back surfaces of the recording sheet is subjected to the image recording operation (that is, the two-sided recording operation is performed), the path-switching member 41 initially maintains the recording sheet discharged posture (as shown in FIG. 4), and the recording sheet whose front surface has been subjected to the image recording operation is transferred downward in the sheet transferring direction. Thereafter, the path-switching member 41 is changed from the recording sheet discharged posture (shown in FIG. 4) to the recording sheet reversed posture (shown in FIG. 5), and the auxiliary rollers 47 guide the recording sheet 103 toward the sheet-return path 16 while pressing the recording sheet 103.

As shown in FIG. 4, a guide portion 76 is disposed on a downstream side of the path-switching member 41 constructed as described above. The guide portion 76 is provided on a downstream side of the first roller 45 and the second rollers 46 in the sheet transferring direction. A support plate 75 is attached to the frame 53. The support plate 75 supports the guide portion 76.

The guide portion 76 has a proximal portion 77 and guide rollers 78. The proximal portion 77 is fixed to a lower surface of the support plate 75, and the guide rollers 78 are supported by the proximal portion 77. The proximal portion 77 includes a support shaft 79. The guide rollers 78 are rotatably supported by the support shaft 79. It is noted that, in this MFD 10, each of the guide rollers 78 is formed into a spur shape.

The guide portion 76 contacts with a recorded surface of the recording sheet 103 on which the image recording operation has been performed, when the recording sheet 103 is being transferred to the sheet-return path 16 by the respective reverse rotations of the first roller 45 and the second rollers 46. The guide portion 76 does not contact with the recording sheet 103 when the recording sheet 103 is transferred to the sheet-discharge tray 21 by the respective forward rotations of the first roller 45 and the second rollers 46. More specifically, the guide portion 76 is provided at a position at which the guide portion 76 is distant from a phantom line connecting a contact point of the first roller 45 and the second rollers 46, and a contact point of the sheet-discharge roller 62 and the spur rollers 63.

Where the recording sheet 103 is transferred to the sheet-return path 16 in order to perform the image recording operation on the back surface of the recording sheet 103, a portion of the recording sheet 103 which is further from the recording head 39 and is located downstream of the first roller 45 and the second rollers 46 in a sheet-returning direction extending from the first roller 45 and the second rollers 46 toward the sheet-supply roller 25 is forced by rigidity of the recording sheet 103 so as to be parallel to the sheet-return path 16. However, the guide rollers 78 contact with the recorded surface of the recording sheet 103, so that the recording sheet 103 is bent. As a result, the recording sheet 103 winds on the first roller 46 and the second rollers 46, whereby a stable transferring force is provided. Thus, the recording sheet 103 is reliably transferred to the sheet-return path 16.

As shown in FIG. 3, the sheet-return path 16 is connected to or communicated with the sheet-transfer path 23 through which the recording sheet supplied by the sheet-supply roller 25 is transferred to the recording portion 24, and is continuous with the downstream portion 36 of the sheet-transfer path 23 which is located on the downstream side of the recording portion 24 in the sheet transferring direction. The sheet-return path 16 is a path that again guides, to the sheet-supply roller 25, the recording sheet whose front surface has been subjected to the image recording operation.

This sheet-return path 16 extends obliquely downward from the downstream portion 36 of the sheet-transfer path 23 toward the sheet-supply roller 25 and is defined by a first guide face 82 as an inner face, a second guide face 33*a* as an upstream outer face, and a second guide face 33*b* as a downstream outer face. The second guide face 33*a* is disposed so as to face to the first guide face 32 with a predetermined distance interposed therebetween. The second guide face 33*b* is continuous to the second guide face 33*a*. It is noted that, in this MFD 10, the first guide face 32 is provided by a surface of a guide member 34, the second guide face 33*a* is provided by a surface of a guide member 85, and the second guide face 33*b* is provided by a surface of a flap 37.

The flap 37 providing the second guide face 33*b* is for introducing the recording sheet whose front surface has been subjected to the image recording operation toward the sheet-supply roller 25 while backing up or supporting the recording sheet at the back surface thereof. The flap 37 has a plate-like shape so as to be continuous from a position adjacent to a downstream end of the guide member 35 and extend obliquely downward to a position slightly upstream of the sheet-supply roller 25. That is, the flap 37 is disposed between the sheet retransferring mechanism described above and the sheet-supply roller 25.

The flap 37 is supported at an upstream portion thereof by a shaft 37*d*, and is pivotable about the shaft 37*d* as a pivotal shaft. Thus, the flap 37 is movable upward and downward such that the flap 37 can be distant from and contact with the sheet-supply tray 20. Further, since each of the sheet-supply roller 25 and the flap 37 is supported so as to be rotatable, a distance between the sheet-supply roller 25 and the flap 37 can be kept constant regardless of an amount of the recording sheets stacked on the sheet supply tray 20. Therefore, where the recording sheet transferred onto the flap 37, (i.e., the recording sheet whose front surface has been subjected to the image recording operation) is resupplied by the sheet-supply roller 25, supplying performance of the recording sheet can be stabilized.

Further, the flap 37 is forced so as to pivot downward by a self-weight thereof and a force of a spring, not shown, so that a portion of the flap 37 contacts with the sheet-supply tray 20 (i.e., an uppermost one of the recording sheets stacked on the sheet-supply tray 20). Thus, the recording sheet can be reliably introduced to the sheet-supply roller 25 without floating-up of the recording sheet which has not been subjected to the image recording operation and is accommodated in the sheet-supply tray 20.

Here, there will be explained, with reference to FIGS. 9 and 10, the sheet-discharge tray 21, the flap 37, and the sheet-supply tray 20 in more detail. It is noted that the sheet-supply roller 25 and the sheet-supply arm 26 are omitted in FIG. 10, although shown in FIG. 9.

The sheet-discharge tray 21 is attached to the sheet-supply tray 20 so as to cover an opening of the sheet-supply tray 20 from which the uppermost recording sheet in the sheet-supply tray 20 is exposed. The sheet-discharge tray 21 is for receiving the discharged recording sheet and for opening and closing the opening of the sheet-supply tray 20. That is, the sheet-discharge tray 21 functions as a tray cover configured to open and close the opening. The sheet-discharge tray 21 is inserted and removed together with the sheet-supply tray 20 through the opening 13 (with reference to FIG. 1) formed in the front face of the MFD 10. When the sheet-discharge tray 21 is rotated about a shaft 21*a* in a direction indicated by arrow A as shown in FIG. 9 in a state in which the sheet-supply tray 20 is removed from the MFD 10, the opening of the sheet-supply tray 20 is opened, so that the recording sheet can be set in the sheet-supply tray 20. Further, the sheet-supply tray 20 is set to the MFD 10 in a state in which the opening of the sheet-supply tray 20 is closed by the sheet-discharge tray 21, whereby the recording sheet is discharged onto the sheet-discharge tray 21 such that the recording sheet is stacked on other recording sheets which have been discharged before.

The flap 37 supports the recording sheet, whose front surface has been subjected to the image recording operation, at a surface (i.e., the back surface) opposite to the front surface of the recording sheet. In other words, the flap 37 supports the recording sheet while being held in contact with the back surface of the recording sheet. The flap 37 is constituted by a main body portion 37*a*, contact portions 37*b*, and guide portions 37*c*. The main body portion 37*a* extends toward the sheet-supply roller 25 from a downstream portion of the sheet-discharge tray 21 in the sheet transferring direction (more specifically, from a position at which the shaft 37*d* is provided). The contact portions 37*b* extend from the main body portion 37*a* so as to interpose the sheet-supply roller 25 between the contact portions 37*b*. Further, the contact portions 37*b* contact with the recording sheet stacked on the sheet-supply tray 20. The guide portions 37*c* are respectively continuous to the contact portions 37*b* and extend while being curved toward the slant sheet separator plate 22 in a direction away from the sheet-supply tray 20. That is, the guide portions 37*c* are curved such that as respective parts of the guide portions 37*c* are nearer to the slant sheet separator plate 22, a distance between the respective parts of the guide portions 37*c* and a lower surface of the MFD 10 is increased.

The main body portion 37*a* is pivotably attached at both of opposite ends thereof to the sheet-discharge tray 21 via the shaft 37*d*. Further, the main body portion 37*a* is tapered, in a widthwise direction of the recording sheet, from the sheet-discharge tray 21 toward the sheet-supply roller 25 and is connected to the contact portions 37*b*.

The contact portions 37*b* respectively extend from opposite end portions of the main body portion 37*a* such that the sheet-supply roller 25 is interposed between the contact portions 37*b*. One of faces of the contact portions 37*b* which is nearer to the sheet-supply tray 20 contacts the recording sheet accommodated in the sheet-supply tray 20. These contact portions 37*b* press the recording sheet accommodated in the sheet-supply tray 20, thereby preventing the recording sheet from floating up.

The flap 37 has a cutout through which the sheet-supply roller 25 contacts with the recording sheet, and portions of the flap 37 which are adjacent to the cutout respectively function as the guide portions 37*c*. The guide portions 37*c* guide, toward the sheet-transfer path 23, the recording sheet which is stacked on the sheet-supply tray 20 and the recording sheet whose front surface has been subjected to the image recording operation. The recording sheet supplied by the sheet-supply roller 25 is supplied to the sheet-transfer path 23 along the guide portions 37*c* while being guided in a direction in which the recording sheet is supplied. In this case, the guide portions 37*c* are formed so as to be curved toward the sheet-transfer path 23 in the direction away from the sheet-supply tray 20, and thus the recording sheet can be smoothly guided to the sheet-transfer path 23 having the U-shape. Further, since the cutout is formed between the guide portions 37*c*, the recording sheet supplied by the sheet-supply roller 25 can be guided just after the supplying of the sheet-supply roller 25, whereby the supplying performance of the recording sheet can be further stabilized. Furthermore, since the recording sheet whose front surface has been subjected to the image recording operation is transferred on the flap 37, there is no need for additionally forming a path for the recording sheet.

As described above, the sheet-supply tray 20 has a box-like shape opening upward, and the recording sheets can be stacked in the sheet-supply tray 20. In the sheet-supply tray 20, there are erected a pair of side guides 201 which hold the stacked recording sheets accommodated in the sheet-supply tray 20 in a widthwise direction of the recording sheets.

The side guides 201 are slidable in a direction indicated by arrow B (in the main scanning direction). That is, the side guides 201 are adjustable in a distance therebetween. The slide guides 201 are slid in accordance with a size of the recording sheets stacked on the sheet-supply tray 20, thereby holding the recording sheets. Thus, each of the recording sheets stacked on the sheet-supply tray 20 is supplied along the side guides 201, thereby preventing the recording sheet from being transferred obliquely in the widthwise direction thereof.

Figure 11A:
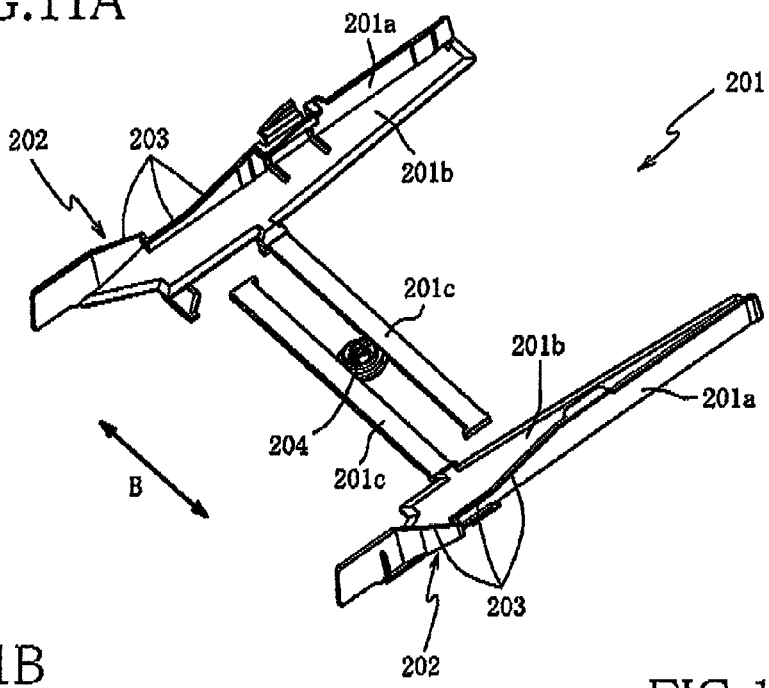
FIG. 11A is a perspective view showing a pair of side guides.
Figure 11B:
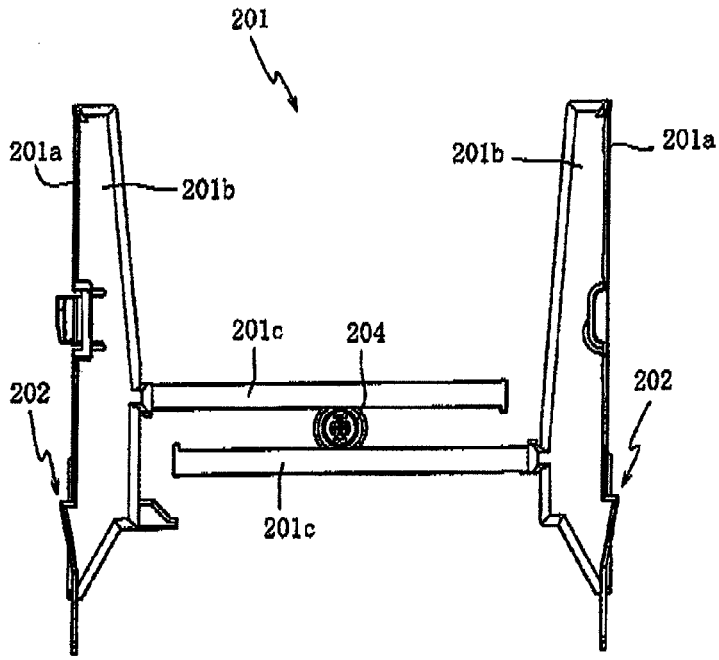
FIG. 11B is a plan view showing the pair of side guides.
Figure 11C:
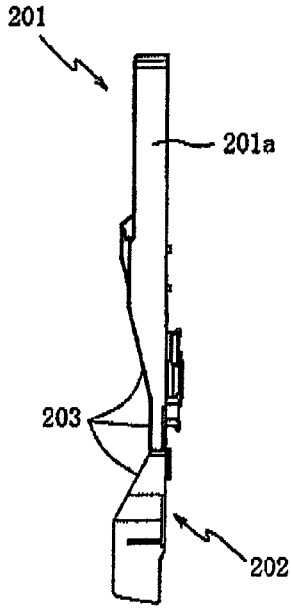
FIG. 11*c* is a side view showing the pair of side guides.

Here, there will be explained, with reference to FIG. 11, the pair of side guides 201 in detail. FIG. 11A is a perspective view showing the side guides 201. FIG. 11B is a plan view showing the side guides 201. FIG. 11*c* is a side view showing the side guides 201.

The side guides 201 respectively include a pair of side walls 201*a*, base walls 201*b*, and distance adjusting bars 201*c*. The side walls 201*a* are provided in the sheet-supply tray 20 so as to be erected and faced to each other and extend and hold respective edge portions of the recording sheets accommodated in the sheet-supply tray 20 in the widthwise direction of the recording sheets. The base walls 201*b* extend inward from respective bottom ends of the side walls 201*a* and respectively support the side walls 201*a*. Each of the distance adjusting bars 201*c* extends from a corresponding one of the side walls 201*a* toward the other of the side walls 201*a*.

The side walls 201*a* are provided so as to be erected to a position above the flap 37 from the respective base walls 201*b* disposed on a bottom wall of the sheet-supply tray 20. Thus, the side walls 201*a* correct that each of the recording sheets stacked on the sheet-supply tray 20 is transferred obliquely in the widthwise direction of the recording sheets, and correct that the recording sheet whose front surface has been subjected to the image recording operation and which is transferred on the flap 37 is transferred obliquely in a widthwise direction of the recording sheet. In order to correct the oblique transferring of the recording sheet whose front surface has been subjected to the image recording operation, the side walls 201*a* are respectively provided with side guide portions 202 in particular.

The side guide portions 202 are respectively formed on the side walls 201*a* such that a distance between the side guide portions 202 in a widthwise direction of the recording sheet is larger than a width of the recording sheet at respective parts of the side guide portions 202 and is gradually decreased from the parts toward the sheet-supply roller 25 to be equal to the distance between the side walls 201*a* on an upstream side of the sheet-supply roller 25 in the sheet transferring direction. That is, the side guide portions 202 are inclined relative to each other such that the distance therebetween at the respective parts thereof is larger than the distance therebetween at respective downstream ends thereof which is equal to the distance between the side walls 201*a*. When the recording sheet whose front surface has been subjected to the image recording operation and which is transferred on the flap 37 is transferred between the side guide portions 202, the edge portions of the recording sheet are respectively brought into contact with the side guide portions 202, whereby the oblique transferring of the recording sheet in the widthwise direction thereof is corrected.

Further, respective side faces of the side guide portions 202 which face to each other are inclined relative to each other such that the side faces become nearer to each other in a direction from the uppermost recording sheet toward a lowermost recording sheet (i.e., in a downward direction or toward lower portions thereof. That is, the side faces of the side guide portions 202 are inclined relative to each other such that a distance therebetween at respective upper positions thereof is larger than a distance therebetween at respective lower positions thereof. Thus, the recording sheet whose front surface has been subjected to the image recording operation is guided along the respective side faces of the side guide portions 202 in a direction directed from the uppermost one of the recording sheets stacked on the sheet-supply tray 20 toward a lowermost one of the recording sheets. Consequently, even where the recording sheet whose front surface has been subjected to the image recording operation is transferred obliquely in a sheet-stack direction in which the recording sheets are stacked in the sheet-supply tray 20, the oblique transferring can be corrected.

Further, as shown in FIG. 12, the side guide portions 202 are configured such that respective upper end portions of thereof in the sheet-stack direction is above a position of the contact portions 37*b* of the flap 37 (specifically, a position of the recording sheet transferred on the contact portions 37*b* toward the sheet-supply roller 25) in the sheet-stack direction where the contact portions 37*b* presses the uppermost one of the recording sheets stacked on the sheet-supply tray 20. Thus, the recording sheet whose front surface has been subjected to the image recording operation and which is supported by the flap 37 is reliably transferred into between the side guide portions 202. Consequently, the oblique transferring can be corrected by the side guide portions 202.

Figure 9:
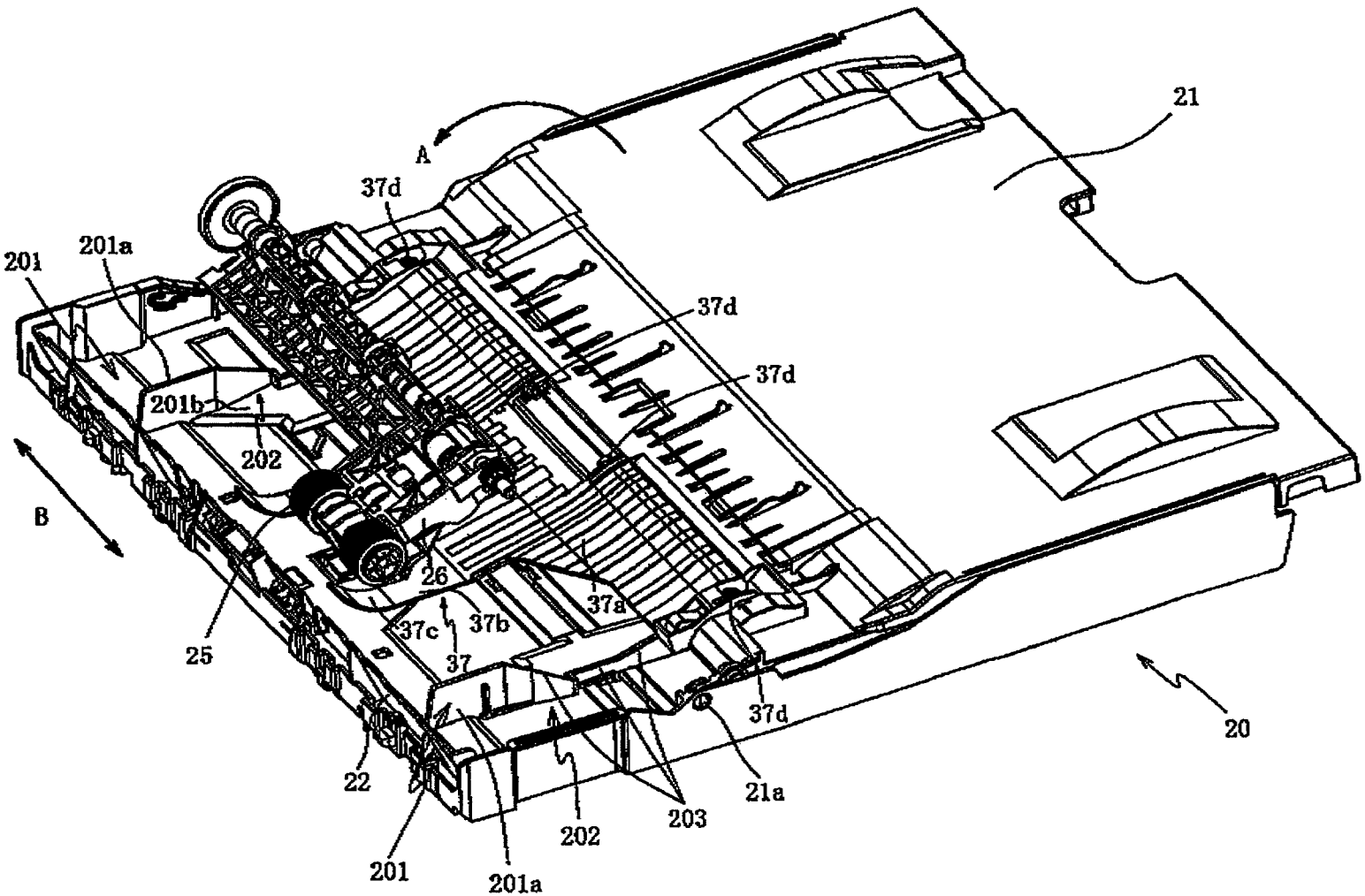
FIG. 9 is a perspective view mainly showing a sheet-discharge tray, a flap, and a sheet-supply tray.
Figure 10:
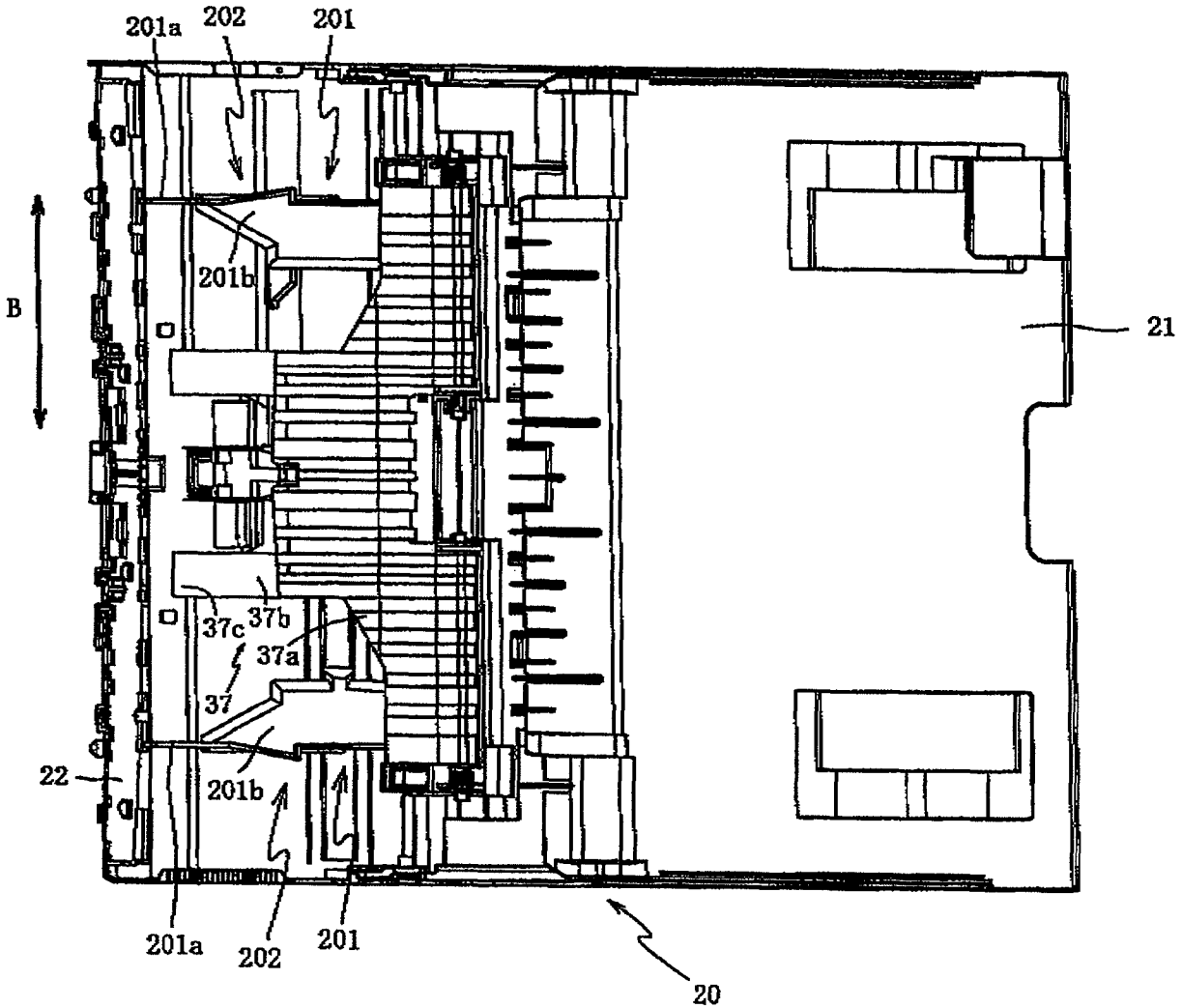
FIG. 10 is a plan view mainly showing the sheet-discharge tray, the flap, and the sheet-supply tray.

Further, as shown in FIGS. 9 and 10, portions of the flap 37 which are respectively adjacent to the side guide portions 202 are cut out so as to provide a pair of cutouts, from which the side walls 201*a* are respectively projected, so that in spaces respectively adjacent to the side guide portions 202, the flap 37 is not formed. Thus, when the side guide portions 202 correct the oblique transferring of the recording sheet whose front surface has been subjected to the image recording operation, a reaction force generated on the recording sheet in reaction to this correction can be absorbed without being inhibited by the flap 37.

The distance adjusting bars 201*c* are for reflecting an amount of movement of one of the side walls 201*a* to that of the other of the side walls 201*a*. Gears, not shown, are respectively formed in edge portions of the respective distance adjusting bars 201*c* which are face to each other. The gears are meshed with a rotational gear 204 which is interposed between the distance adjusting bars 201*c* and is rotatably disposed on the bottom wall of the sheet-supply tray 20.

Thus, when the user slides the one of the side walls 201*a* in the direction indicated by the arrow B, the other of the side walls 201*a* is slid in a direction opposite to the direction indicated by the arrow B by an amount the same as an amount by which the one of the side walls 201*a* is slid. As a result, the distance between the side guides 201 can be adjusted to the width of the recording sheet accommodated in the sheet-supply tray 20.

Further, in respective upper end portions of the side walls 201*a*, there are formed cams 203 which are brought into contact with the flap 37 so as to regulate or adjust a position of the flap 37 relative to the recording sheet accommodated in the sheet-supply tray 20, in other words, regulate a direction in which the flap 37 is moved. As shown in FIG. 11C, from an upstream side toward a downstream side in the sheet transferring direction (i.e., from an upper side toward a lower side in FIG. 11C), the cam 203 initially inclines downward, then extends horizontally in a specific distance, and finally inclines upward. As a result, upper ends of downstream parts (on which the side guide portions 202 are respectively formed) of the respective side walls 201*a* in the sheet transferring direction are higher than upper ends of upstream parts of the respective side walls 201*a* in the sheet transferring direction. Further, the upper ends of the downstream parts of the respective side walls 201*a* are generally equal to upper ends of the sheet-supply tray 20 in height and higher than the uppermost one of the recording sheets in a state in which the recording sheets are fully accommodated in the sheet-supply tray 20.

Here, there will be explained, with reference to FIG. 12, an operation of the flap 37 moved along the cam 203. FIGS. 12A through 12D are views each schematically showing a state in which the sheet-discharge tray 21 is pivoted relative to the sheet-supply tray 20.

Figure 12A:
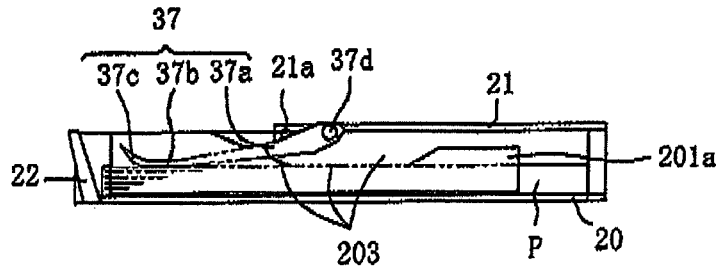
FIGS. 12A through 12D are views each schematically showing a state in which the sheet-discharge tray is pivoted relative to the sheet-supply tray.

As shown in FIG. 12A, in the state in which the opening of the sheet-supply tray 20 is closed by the sheet-discharge tray 21, recording sheets P in the sheet-supply tray 20 are pressed by the contact portions 37*b* of the flap 37, thereby being prevented from floating up. It is noted that, in this case, the flap 37 functions as a pressing member configured to press the recording sheets P.

Further, in this state, each of the recording sheets accommodated in the sheet-supply tray 20 and supplied by the sheet-supply roller 25 is guided by the guide portions 37*c* of the flap 87 (in particular, respective lower faces of the guide portions 37*c*) toward the sheet-transfer path 23 while the recording sheet which is transferred on the flap 37 and whose front surface has been subjected to the image recording operation and supplied by the sheet-supply roller 25 is guided by the guide portions 37*c* of the flap 37 an particular, respective upper faces of the guide portions 37*c*) toward the sheet-transfer path 23. Thus, even where the recording sheets are pressed by the contact portions 37*b* of the flap 37, the recording sheet can be stably supplied to the sheet-transfer path 23.

Figure 12B:
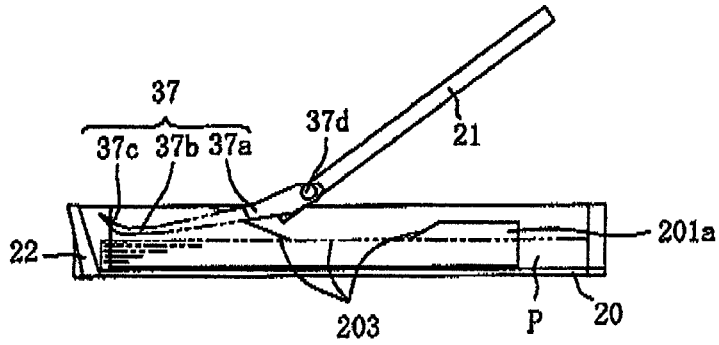
Figure 12C:
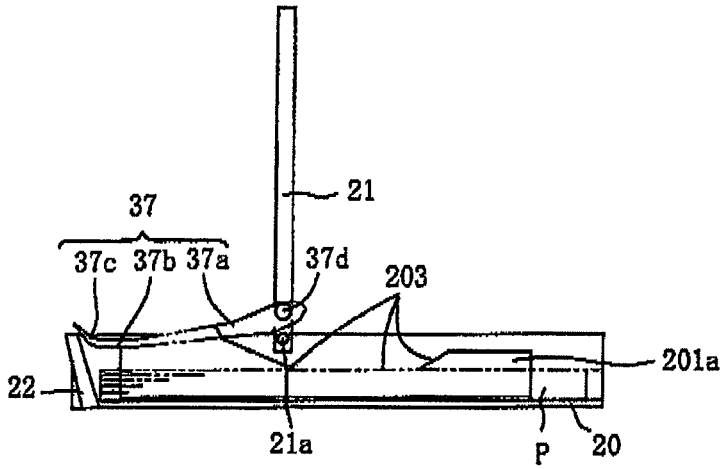
Figure 12D:
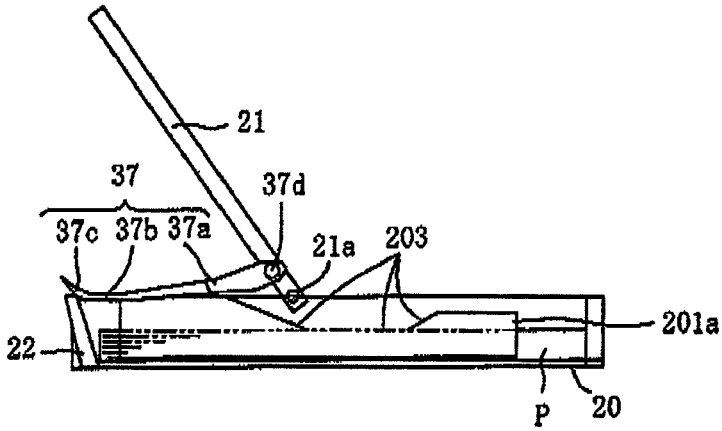

On the other hand, as shown in FIGS. 12B-12D, when the sheet-discharge tray 21 is pivoted about the shaft 21*a* in a state in which the sheet-supply tray 20 is removed from a main body of the MFD 10, the flap 37 is pivoted about the shaft 37*d* relative to the sheet-discharge tray 21 and moved along the cam 203 formed in the side walls 201*a*. More specifically, the flap 37 is moved upward (i.e., in a direction away from the recording sheets stacked on the sheet-supply tray 20) in accordance that the sheet-discharge tray 21 is opened, while contacting with the portion of the cam 203 which inclines upward. Thus, since the cam 203 is formed in parts of the respective side walls 201*a*, the contact portions 37*b* of the flap 37 are moved upward with a simple structure in comparison with a case in which the cam 203 is formed in a component different from the side walls 201*a*.

In view of the above, the flap 37 is movable along the cams 203 in the direction away from the sheet accommodated in the sheet-supply tray 20 while being pivoted relative to the sheet-discharge tray 21 in accordance that the sheet-discharge tray 21 is pivoted relative to the sheet-supply tray 20 in a direction in which the opening is opened. In other words, the flap 37 is movable along the cams 203 between (a) a position at which the flap 37 presses the sheet accommodated in the sheet-supply tray 20 in the state in which the opening of the sheet-supply tray 20 is closed by the sheet-discharge tray 21 and (b) a position at which the flap 37 is distant from the sheet accommodated in the sheet-supply tray 20 in the state in which the opening of the sheet-supply tray 20 is opened by the sheet-discharge tray 21.

Thus, the opening of the sheet-supply tray 20 which has been closed by the sheet-discharge tray 21 is opened, and the contact portions 37*b* of the flap 37 are moved to the position distant from the bottom wall of the sheet-supply tray 20. Consequently, the recording sheets can be smoothly accommodated in the sheet-supply tray 20.

There will be next explained a configuration of a controller 84 of the MFD 10 with reference to FIG. 13. The controller 84 executes controls for operations of the MFD 10 which include operations of not only the printer section 11 but also the scanner section 12, but a detailed explanation of the operation of the scanner section 12 is dispensed with.

As shown in FIG. 13, the controller 84 is constituted by a microcomputer mainly including a Central Processing Unit (CPU) 88, a Read Only Memory (ROM) 89, a Random Access Memory (RAM) 90, and an Electrically Erasable and Programmable ROM (EEPROM) 91 storing flags, settings, and the like which should be kept also after turning a power off. The controller 84 is connected to an Application Specific Integrated Circuit (ASIC) 93 via a bus 92.

The ROM 89 stores programs and the like for controlling various operations of the MFD 10. For example, the ROM 89 stores a recording processing program 89*a* for performing a two-sided recording processing shown in FIG. 12 by the CPU 88. The RAM 90 functions as a working area or a storage area which temporarily stores various data used when the CPU 88 executes the programs.

The ASIC 93 produces, on the basis of a command from the CPU 88, a phase excitation signal and the like for energizing the LF motor 71. The signal is transmitted to a drive circuit 94 of the LF motor 71, and a drive signal is transmitted, via the drive circuit 94, to the LF motor 71 for the energization. Thus, the rotation of the LF motor 71 is controlled.

The drive circuit 94 is for driving the LF motor 71 connected to the sheet-supply roller 25, the sheet-feed roller 60, the sheet-discharge roller 62, the first roller 45, and so on. The drive circuit 94 receives an output signal from the ASIC 93 and produces an electric signal for rotating the LF motor 71. The LF motor 71 receives the electric signal and is rotated on the basis of the electric signal. A rotational force of the LF motor 71 is transmitted to the sheet-supply roller 25, the sheet-feed roller 60, the sheet-discharge roller 62, and the first roller 45 via a known drive mechanism constituted by gears and a drive shaft and so on.

In this MFD 10, the LF motor 71 functions as a drive source for supplying the recording sheet from the sheet-supply tray 20. Further, the LF motor 71 functions as a drive source for transferring the recording sheet located on the platen 42 and discharging the recorded recording sheet onto the sheet-discharge tray 21. Furthermore, the LF motor 71 functions as a drive source for driving the sheet-discharge roller 62 via a specific drive-power transmitting mechanism.

That is, the LF motor 71 drives the sheet-supply roller 25 via the drive-power transmitting mechanism 27, the sheet-discharge roller 62 via the specific drive power transmitting mechanism, and the sheet-feed roller 60. It is noted that the specific drive-power transmitting mechanism may be constituted by gear trains for example. Further, for the specific drive-power transmitting mechanism, other components such as a timing belt may be used depending upon an assembling space required for the specific drive-power transmitting mechanism.

The ASIC 93 produces, on the basis of a command of the CPU 88, a phase excitation signal and the like for energizing the CR (carriage) motor 95. The signal is transmitted to a drive circuit 96 of the CR motor 95, and a drive signal is transmitted, via the drive circuit 96, to the CR motor 95 for the energization. Thus, the rotation of the CR motor 95 is controlled.

The drive circuit 96 is for driving the CR motor 95 connected to the carriage 38. The drive circuit 96 receives an output signal from the ASIC 93, and produces an electric signal for rotating the CR motor 95. The CR motor 95 receives the electric signal and is rotated on the basis of the electric signal. A rotational force of the CR motor 95 is transmitted to the carriage 38, so that the carriage 38 is reciprocated.

A drive circuit 97 is for driving the recording head 39 so that the recording head 39 ejects the ink onto the recording sheet at suitable timings. On the basis of a drive controlling procedure outputted from the CPU 88, the drive circuit 97 receives an output signal produced by the ASIC 93 and controls the driving of the recording head 39.

To the ASIC 93, there are connected the scanner section 12, the operation panel 40 for commanding the operations of the MFD 10, the slot portion 43 into which the memory cards of various small types are inserted, a parallel interface (I/F) 98 and a USB interface (I/F) 99 each for transmitting and receiving data to and from an external device such as a personal computer via a corresponding one of a parallel cable and a USB cable, and a Network Control Unit (NCU) 100 and a modem 101 for realizing the facsimile function.

In addition, to the ASIC 93, there are connected the register sensor 102 for detecting that the recording sheet has been transferred from the sheet-supply roller 25 to a vicinity of the sheet-feed roller 60, a rotary encoder 87 for detecting respective rotational amounts of the rollers driven by the LF motor 71, the linear encoder 85 for detecting an amount of the movement of the carriage 38, and the media sensor 86 for detecting the presence and the absence of the recording sheet on the platen 42.

Here, there will be briefly explained processings performed by the controller 84 of the MFD 10. When the MFD 10 is turned on, the carriage 38 is temporarily moved to one of opposite ends of a range in which the carriage 38 is reciprocated, and a detecting position of the linear encoder 85 is initialized. When the carriage 38 is moved or slid from the initial position, the optical sensor provided on the carriage 88 detects the pattern of the encoder strip.

The controller 84 recognizes an amount of the movement of the carriage 38 by a number of pulse signals which are based on the detection of the optical sensor. On the basis of the amount of the movement, the controller 84 controls the rotation of the CR motor 95 in order to control the reciprocation of the carriage 38. Further, on the basis of an output signal of the register sensor 102 and an encoded amount detected by the rotary encoder 87, the controller 84 recognizes an amount of transferring of the recording sheet, and a position of the leading end or a position of the trailing end of the recording sheet.

When the leading end of the recording sheet reaches a prescribed position of the platen 42, the controller 84 controls the rotation of the LF motor 71 in order to intermittently feed the recording sheet at the predetermined line transfer pitch. The line transfer pitch is set on the basis of a resolution and the like inputted as a condition of the image recording operation. In particular, where the image recording operation is performed at a high resolution, or a non-margin recording operation is performed, the controller 84 precisely detects the positions of the leading end and the trailing end of the recording sheet on the basis of the detection of the presence of the recording sheet by the media sensor 86 and the encoded amount detected by the rotary encoder 87.

Further, the controller 84 precisely detects respective positions of lateral opposite ends of the recording sheet on the basis of the detection of the presence of the recording sheet by the media sensor 86 and an encoded amount detected by the linear encoder 85. On the basis of the thus detected respective positions of the leading end, the trailing end, and the lateral ends of the recording sheet, the controller 84 controls the ejection of the ink as ink droplets by the recording head 39.

Figure 14:
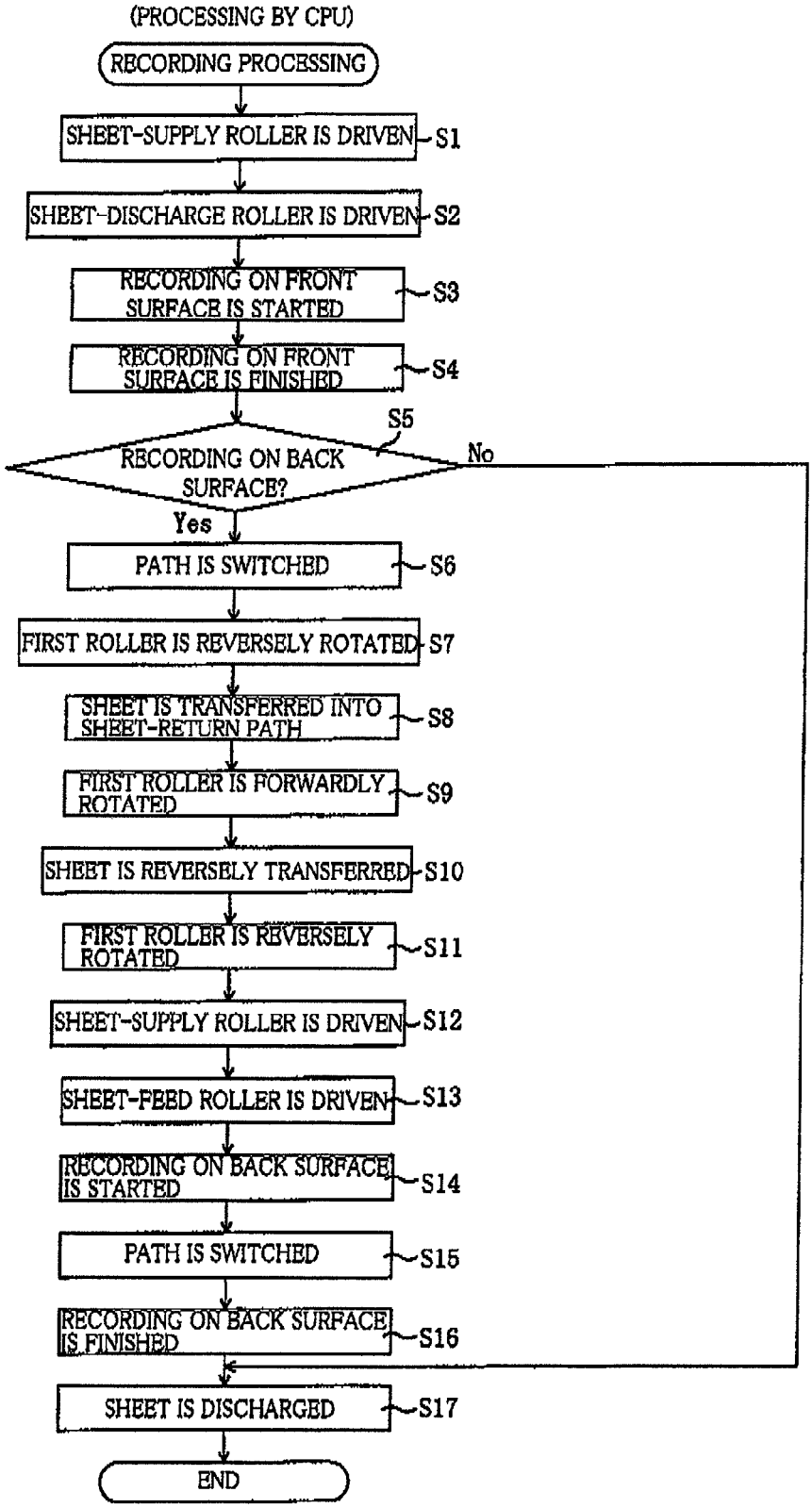
FIG. 14 is a flow-chart showing a recording processing.

There will be next explained, with reference to FIG. 14, the recording processing performed by the CPU 88 of the MFD 10. FIG. 14 is a flow-chart showing the recording processing.

Figure 15:
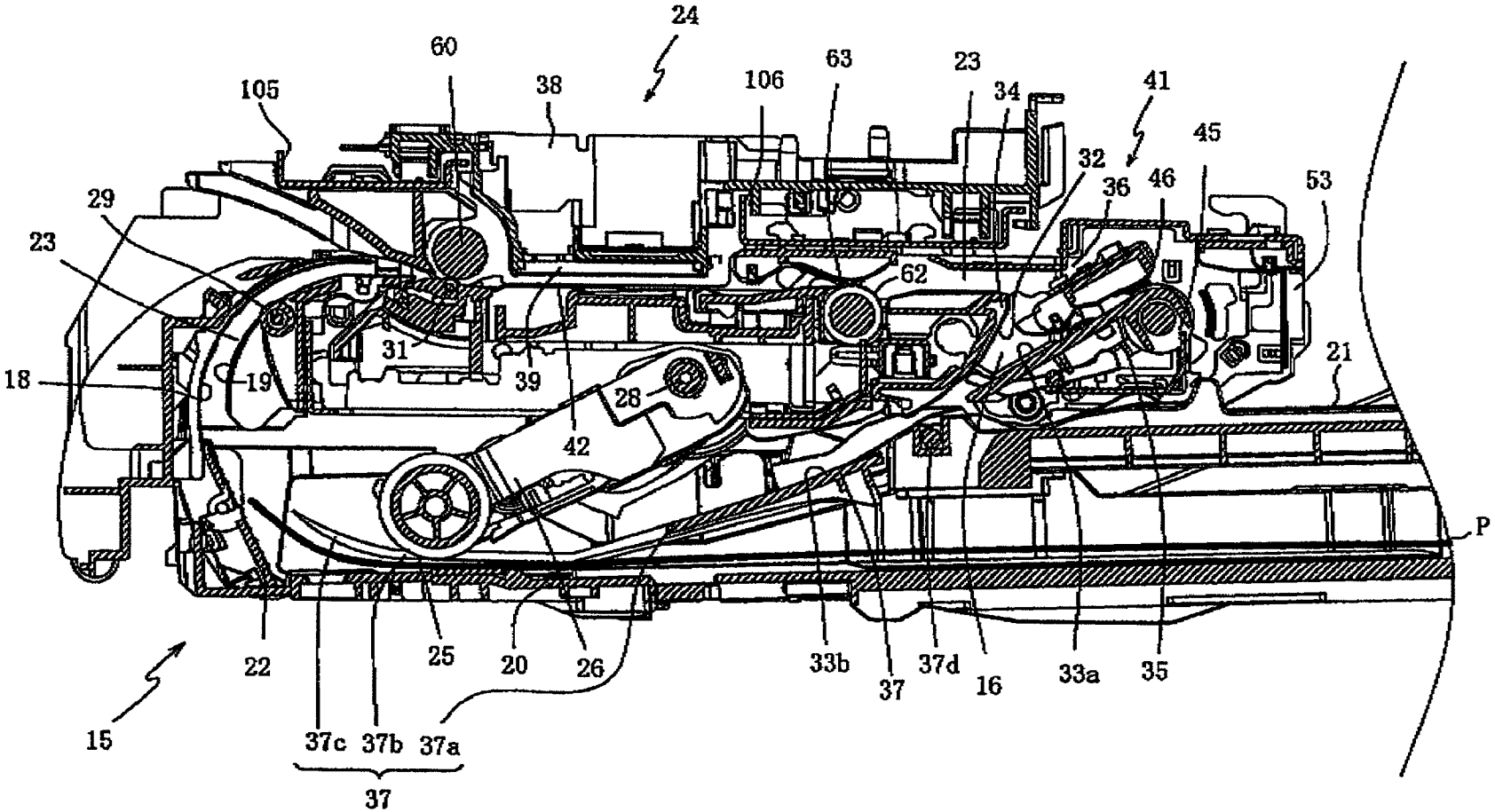
FIG. 15 is an enlarged cross-sectional view partly showing the printer section.

In this recording processing, when a command for starting the image recording operation is inputted, the sheet-supply roller 25 is driven in S1, and the recording sheet P is transferred from the sheet-supply tray 20 into the sheet-transfer path 23. In this case, as shown in FIG. 15, the recording sheets P accommodated in the sheet-supply tray 20 are pressed by the contact portions 37*b* of the flap 37. This prevents the recording sheets P from floating up. Further, since a direction in which the recording sheets P are supplied is guided by the guide portions 37*c* of the flap 37 (in particular, by the respective lower faces of the guide portions 37*c*), each of the recording sheets P can be stably supplied toward the sheet-transfer path 23.

When the recording sheet P is supplied into the sheet-transfer path 23 as thus described, the recording sheet P is turned upside down in the sheet-transfer path 23 such that a front surface of the sheet P which is opposite to a surface thereof having contacted with the sheet-supply roller 25 is to be faced to a nozzle face of the recording head 39 in which nozzles are formed.

Then, when the recording sheet P is sensed by the register sensor 102, and the recording sheet P has reached the sheet-feed roller 60 and the pinch roller 31, the sheet-feed roller 60 is driven in S2 after a specific time has passed in order to correct the oblique transferring of the recording sheet P. Then, the sheet-feed roller 60 and the pinch roller 31 nip and transfer the recording sheet P toward a position between the recording head 39 and the platen 42, and the image recording operation is started in S3 to be performed for the front surface of the recording sheet P which faces to the recording head 39.

In this case, the recording sheet P is intermittently transferred by the sheet-feed roller 60 and the pinch roller 31, and the carriage 38 is slid in a state in which the recording sheet P is stopped, whereby the image is recorded on the front surface of the recording sheet P by the recording head 39.

Further, when the recording sheet P has reached the sheet-discharge roller 62 and the spur roller 63, the recording sheet P is transferred toward a further downstream side in the sheet transferring direction by the sheet-discharge roller 62 and the spur roller 63. Further, when the recording sheet P has reached the first roller 45 and the second rollers 46, the recording sheet P is transferred toward a further downstream side in the sheet transferring direction by the first roller 45 and the second rollers 46. During these transferrings, the image recording operation on the front surface of the recording sheet P is finished in S4.

Next, in S5, the controller 84 judges whether a mode of the image recording operation is set to the one-sided recording mode or the two-sided recording mode. The mode of the image recording operation is set by the user operating the operation panel 40 and the like in advance. Data designating the one-sided recording mode or the two-sided recording mode is transmitted from the operational panel 40 to the RAM 90 of the controller 84, so that the data is stored in the RAM 90.

It is noted that data designating the one-sided recording mode may be stored in advance in the ROM 89 as a default value. In this case, the controller 84 reads data designating the two-sided recording mode from the RAM 90 or the ROM 89, whereby an image is recorded on a back surface of the recording sheet P.

Where the one-sided recording mode is set (S5: No), the image is recorded in S4 on the front surface of the recording sheet P. Then, in S17, the first roller 45 and the second rollers 46 are continued to be driven to transfer the recording sheet P toward the further downstream side in the sheet transferring direction, so that the recording sheet P is discharged onto the sheet-discharge tray 21. It is noted that where the one-sided recording mode is set (S5: No), the path-switching member 41 is always in the recording sheet discharged posture (with reference to FIG. 4).

On the other hand, where the two-sided recording mode is set (S5: Yes), the image is recorded in S4 on the front surface of the recording sheet P. Then, the first roller 45 and the second rollers 46 are temporarily stopped, and the path-switching member 41 takes the recording sheet reversed posture (with reference to FIG. 5) in S6.

When the path-switching member 41 is changed to the recording sheet reversed posture, the path-switching member 41 is pivoted about the central shaft 52 of the first roller 45. That is, the second rollers 46 roll on a circumferential surface of the first roller 45 while nipping the recording sheet P with the first roller 45, and the recording sheet P is pressed by the auxiliary roller 47.

In other words, the second rollers 46 roll on the circumferential surface of the first roller 45 such that the recording sheet P is winded around the circumferential surface of the first roller 45. As a result, the recording sheet P is pressed from the front surface thereof by the auxiliary roller 47 toward the sheet-return path 16, and a leading end of the back surface (i.e., a trailing end of the front surface) of the recording sheet P which is located on an upstream side of a trailing end of the back surface (i.e., a leading end of the front surface) enters into the sheet-return path 16 (with reference to FIG. 5).

Figure 16:
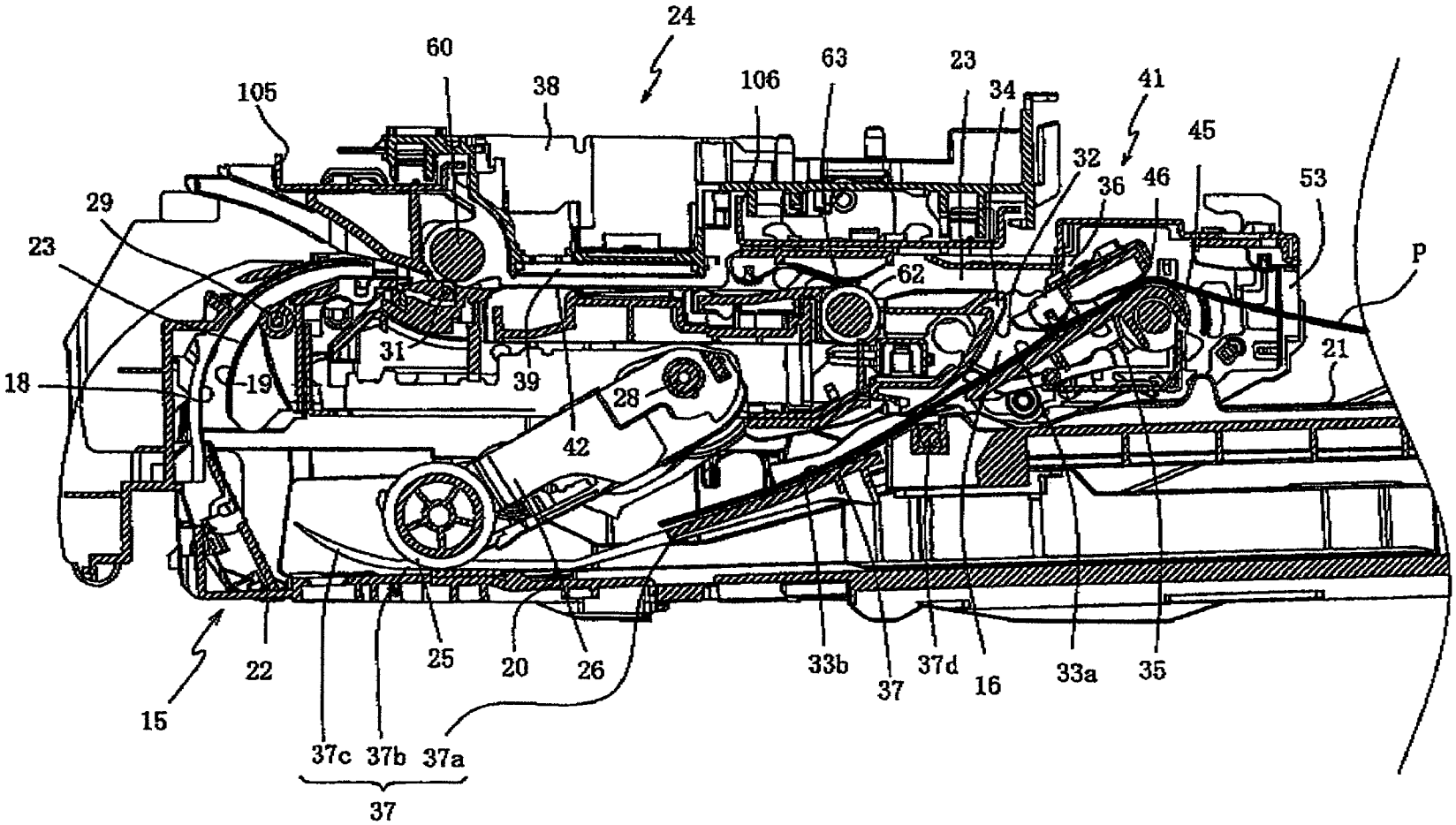
FIG. 16 is an enlarged cross-sectional view partly showing the printer section.

Then, the first roller 45 and the second rollers 46 are reversely rotated in one of opposite directions in S7, whereby the recording sheet P is transferred in S8 in the sheet-return path 16 toward the sheet-supply roller 25. As a result, as shown in FIG. 16, the recording sheet P is transferred on the second guide faces 33*a*, 33*b* toward the sheet-supply roller 25 while being nipped by the first roller 46 and the second rollers 46.

When the first roller 45 and the second rollers 46 are reversely rotated in S7, the controller 84 judges via the rotary encoder 87 whether the first roller 45 and the second rollers 46 have rotated by a predetermined reverse rotating amount. This predetermined reverse rotating amount is set in advance to an amount smaller than that required for the trailing end of the front surface (i.e., the leading end of the back surface) of the recording sheet P to reach the side guide portions 202.

Then, when the first roller 45 and the second rollers 46 are reversely rotated by the predetermined reverse rotating amount, the first roller 45 and the second rollers 46 are forwardly rotated again by a predetermined forward rotating amount in S9 in the other of the opposite directions, the recording sheet P is reversely transferred in S10 by a predetermined distance in a direction away from the sheet-supply roller 25. This restrains difference of a bend or deformation of the recording sheet P whose front surface has been subjected to the image recording operation in the widthwise direction thereof. Thus, the oblique transferring of the recording sheet P is corrected when, as described below, the recording sheet P is retransferred to the sheet-supply roller 25 by reversely rotating the first roller 45 and the second rollers 46 again. Thus, resupplying performance of the recording sheet P whose front surface has been subjected to the image recording operation can be stabilized.

When the first roller 45 and the second rollers 46 are forwardly rotated in S9, the controller 84 judges via the rotary encoder 87 whether the first roller 45 and the second rollers 46 are forwardly rotated by the predetermined forward rotating amount or not. The predetermined forward rotating amount is set in advance to an amount smaller than that required for the trailing end of the front surface (i.e., the leading end of the back surface) of the recording sheet P to reach the first roller 45 and the second rollers 46. It is noted that each of the predetermined reverse rotating amount and the predetermined forward rotating amount is suitably set, and thus it is not necessary that the rotating amounts are the same.

Then, when the first roller 45 and the second rollers 46 are forwardly rotated by the predetermined forward rotating amount, the first roller 45 and the second rollers 46 are reversely rotated again in S11. As a result, the recording sheet P is transferred toward the sheet-supply roller 25 again.

Figure 17:
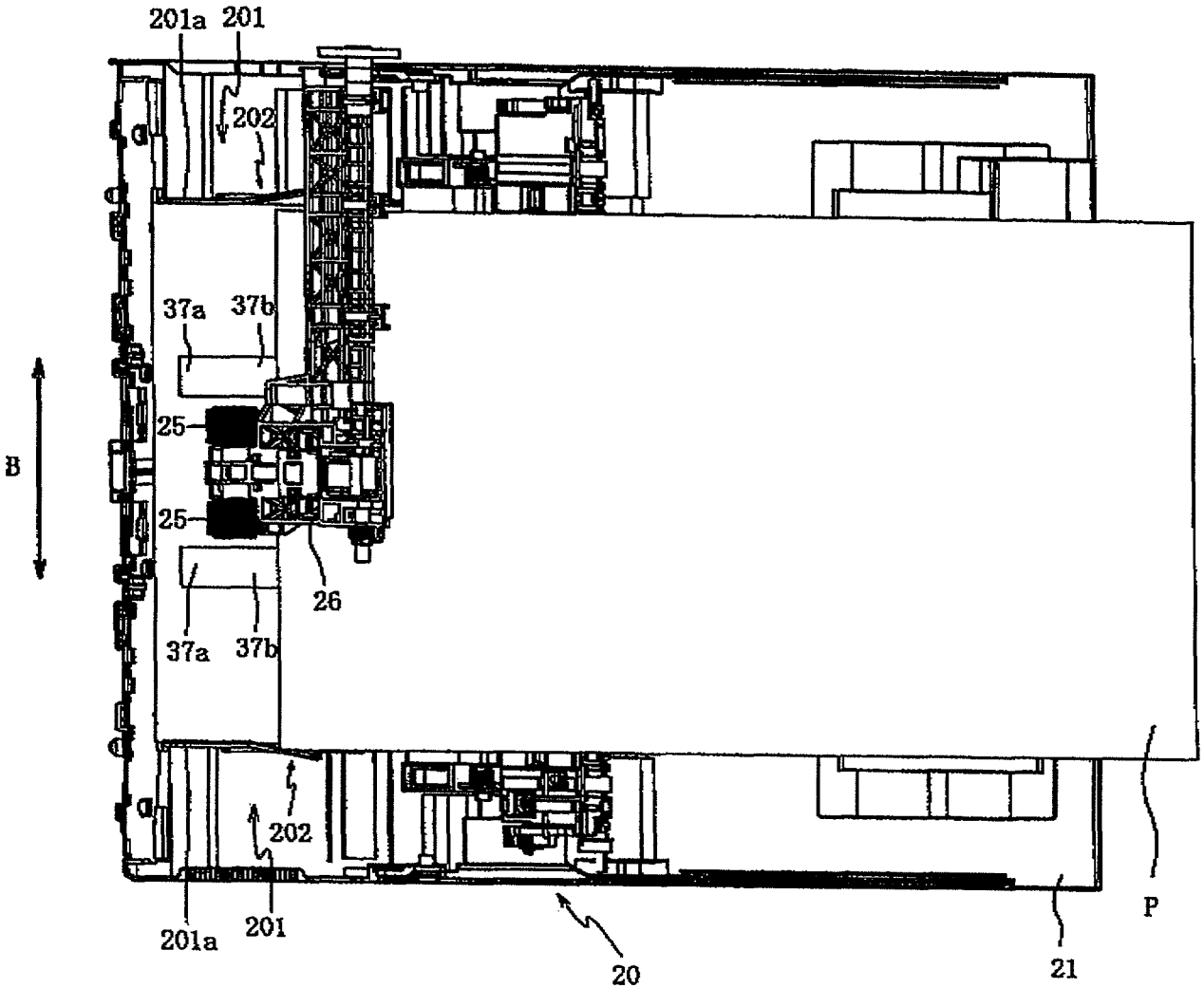
FIG. 17 is a plan view mainly showing the sheet-discharge tray, the flap, and the sheet-supply tray.

Here, the recording sheet P transferred toward the sheet-supply roller 25 reaches the side guide portions 202 formed respectively in the side guides 201 (i.e., the side walls 201*a*) as shown in FIG. 17 before the recording sheet P reaches the sheet-supply roller 25. The oblique transferring of the recording sheet P is corrected by the side guide portions 202. It is noted that, in FIG. 17, the recording sheet P is obliquely transferred in a state in which the recording sheet P is located nearer to one of the side guide portions 202.

Here, there will be explained the correction of the oblique transferring of the recording sheet P more specifically. The transferred recording sheet P is brought into contact with the one of the side guide portions 202 and thus pressed toward the other of the side guide portions 202, whereby the oblique transferring of the recording sheet P is corrected. That is, the side guide portions 202 can correct the oblique transferring of the recording sheet P whose front surface has been subjected to the image recording operation in a widthwise direction of the recording sheet P (i.e., in the direction indicated by the arrow B). Thus, the recording sheet is suitably transferred to the sheet-supply roller 25, so that the supplying performance of the recording sheet of the sheet-supply roller 25 can be stabilized.

When the first roller 45 and the second rollers 46 are reversely rotated in S11 in the one of the opposite directions, the controller 84 judges via the rotary encoder 87 whether the first roller 45 and the second rollers 46 are reversely rotated by a specific reverse rotating amount or not. The specific reverse rotating amount is set in advance to an amount smaller than that required for the trailing end of the front surface (i.e., the leading end of the back surface) of the recording sheet P to reach the sheet-supply roller 25.

Figure 18:
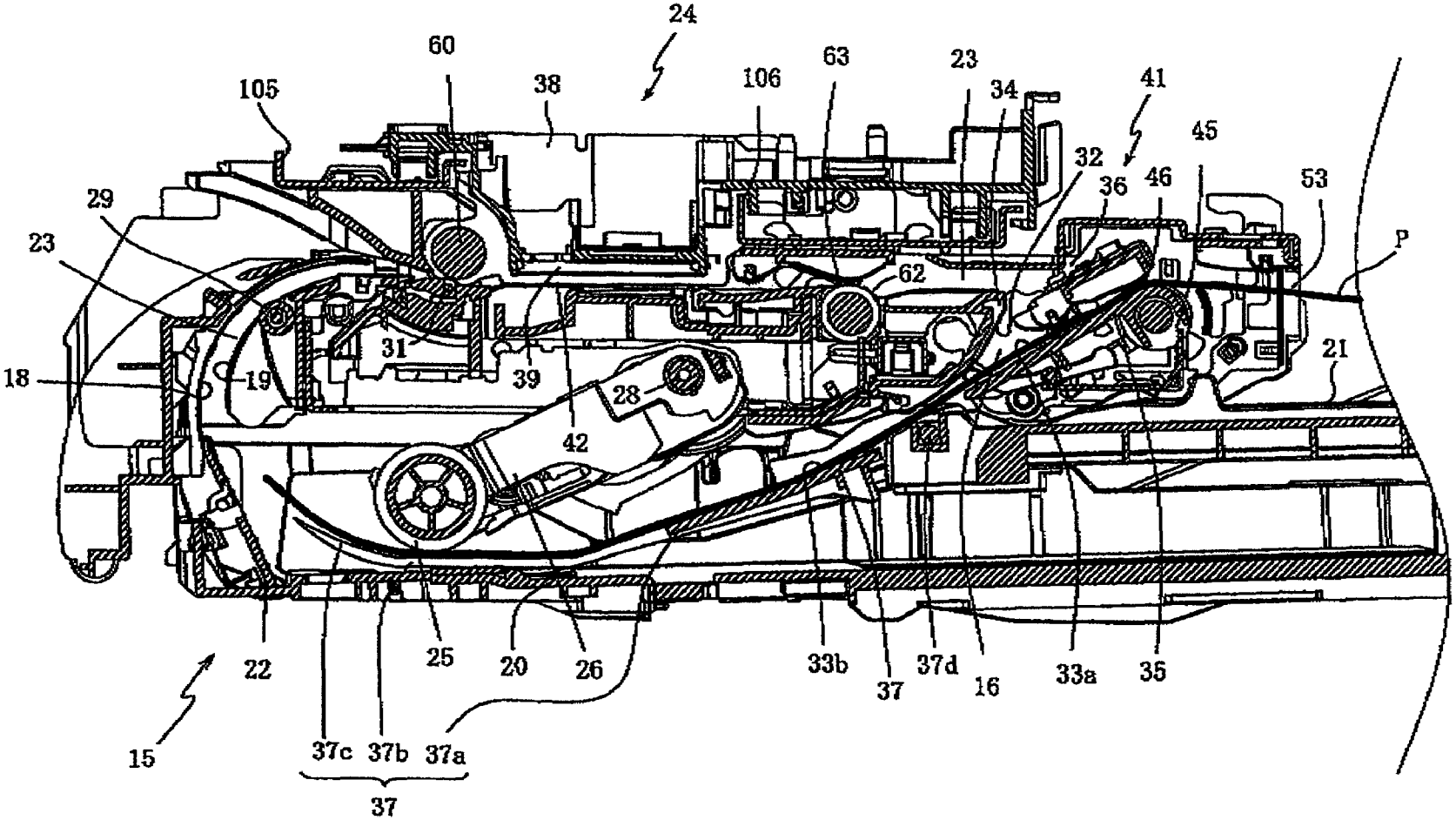
FIG. 18 is an enlarged cross-sectional view partly showing the printer section.

Then, when the first roller 45 and the second rollers 46 are reversely rotated in the one of the opposite directions by specific reverse rotating amount, and the trailing end of the front surface (i.e., the leading end of the back surface) of the recording sheet P has reached the sheet-supply roller 25, the sheet-supply roller 25 is driven in S12. Since, as shown in FIG. 18, the recording sheet P whose front surface has been subjected to the image recording operation is guided by the guide portions 37*c* of the flap 37 (in particular, the respective upper faces of the guide portions 37*c*) in the direction in which the recording sheet P is supplied, the recording sheet P can be stably supplied toward the sheet-transfer path 23 when the sheet-supply roller 25 is driven.

Further, when the sheet-supply roller 25 is driven, the sheet-supply roller 25, and the first roller 45 and the second rollers 46 are simultaneously driven such that an amount of the transferring of the recording sheet P by the sheet-supply roller 25 is smaller than that by the first roller 45 and the second rollers 46. As a result, the recording sheet P in the sheet-return path 16 can be transferred in the state in which the recording sheet P is deformed or bent also in this transferring.

Thus, in this case, compared to a case in which the recording sheet P is transferred in a state in which the recording sheet P is not deformed, a load against the sheet supply roller 25 during the transferring of the recording sheet is reduced, and the sheet-supply roller 25 is less slipped. Thus, there can be restrained that the image recorded on the front surface of the recording sheet P is damaged owing that the image is transferred to a surface of the sheet-supply roller 25 by slipping of the sheet-supply roller 25.

When the sheet-supply roller 25 is driven in S12, the recording sheet P is turned upside down in the sheet-transfer path 23 such that the surface (the back surface) opposite to the surface (the front surface) having contacted with the sheet-supply roller 25 faces to the nozzle face of the recording head 39. Then, the controller 84 detects the recording sheet P via the register sensor 102, and when the recording sheet P reaches the sheet-feed roller 60 and the pinch roller 31, the sheet-feed roller 60 is driven in S13.

Then, when the recording sheet P is transferred or fed onto the platen 42 by the sheet-feed roller 60 and the pinch roller 31, the image is recorded in S14 on the back surface of the recording sheet P by the recording head 39 like the manner as described above. Then, before the leading end of the back surface of the recording sheet P enters to the path-switching member 41, the path-switching member 41 is driven in S15 to be changed from the recording sheet reversed posture (with reference to FIG. 5) to the recording sheet discharged posture (with reference to FIG. 4) again. Then, the image recording operation for the back surface of the recording sheet P is finished in S16, the recording sheet P having been subjected to the two-sided recording operation is transferred downstream in the sheet transferring direction by the first roller 45 and the second rollers 46. In this time, the first roller 45 and the second rollers 46 are forwardly rotated, whereby the recording sheet P is discharged in S17 onto the sheet-discharge tray 21.

There has been explained the embodiment of the present invention. It is to be understood that the above-described embodiment is only by way of example, and the invention may be otherwise embodied with various modifications without departing from the scope and spirit of the invention.

In this MFD 10, the cams 203 which regulate the movement of the flap 37 are respectively formed in the upper edge portions of the respective side walls 201*a*. However, the cam 203 is not limited to be respectively formed in the upper edge portions of the respective side walls 201*a*. That is, where the movement of the flap 37 can be regulated, the MFD 10 may be configured such that cam grooves are respectively formed in the side walls 201*a* in order that the flap 37 is moved along the cam grooves, for example.

Further, in this MFD 10, both of the side guides 201 are movable. However, the MFD 10 may be configured such that one of the side guides 201 is fixed while the other thereof is slidable relative to the one of the side guides 201

Further, in this MFD 10, the side guide portions 202 are formed to respectively extend from the bottom ends to upper ends of the respective side walls 201*a*. However, the MFD 10 may be configured such that the side guide portions 202 are respectively formed only in positions through which the recording sheet P whose front surface has been subjected to the image recording operation is transferred.

Further, in this MFD 10, where the recording sheet P whose front surface has been subjected to the image recording operation is temporarily transferred reversely in the sheet-return path 16, the recording sheet P is reversely transferred before the trailing end of the front surface (i.e., the leading end of the back surface) of the recording sheet P reaches to the side guide portions 202. However, the recording sheet P may be reversely transferred after reaching the side guide portions 202, as long as the trailing end of the front surface (i.e., the leading end of the back surface) of the recording sheet P has not reached the sheet-supply roller 25.

Further, in this MFD 10, after the recording sheet P whose front surface has been subjected to the image recording operation is transferred toward the sheet-discharge tray 21 by forwardly rotating the first roller 45 and the second rollers 46, the recording sheet P is transferred toward the sheet-supply roller 25 by reversely rotating the first roller 45 and the second rollers 46, then is reversely transferred by the predetermined distance by forwardly rotating the first roller 45 and the second rollers 46 by the predetermined forward rotating amount before the leading end of the recording sheet P has reached the sheet-supply roller 25, and then is transferred into between the side guide portions 202 by reversely rotating the first roller 45 and the second rollers 46 again. That is, the timing at which after the recording sheet P whose front surface has been subjected to the image recording operation is temporarily transferred reversely in the sheet-return path 16, the recording sheet P is transferred to the sheet-supply roller 25 again is set to the timing which is after the transferring of the recording sheet P by the predetermined distance. However, the MFD 10 is not limited to this configuration. For example, where a large amount of the ink is ejected to the front surface of the recording sheet P and/or humidity is relatively high, distortion of the recording sheet P whose front surface has been subjected to the image recording operation easily occurs. In this case, the MFD 10 may be configured such that the recording sheet P is reversely transferred by a relatively large amount (i.e., distance). That is, the MFD 10 may be configured such that a recording state of the front surface of the recording sheet P and/or a humidity are/is detected, and an amount by which the recording sheet P is transferred is changed in accordance with the recording state and/or the humidity.

What is claimed is:

1. A sheet accommodating device comprising:

a tray configured to accommodate a sheet; and a pressing member configured to press the sheet accommodated in the tray, wherein the pressing member includes a guide portion configured to guide, where the sheet accommodated in the tray is transferred, the transferred sheet toward a downstream side in a sheet transferring direction in which the sheet is transferred, wherein the sheet accommodating device further comprises a tray cover configured to open and close an opening of the tray, wherein the pressing member is attached to the tray cover and configured to press the sheet accommodated in the tray in a state in which the opening is closed by the tray cover, wherein the guide portion is configured to guide, where the sheet accommodated in the tray is transferred in the state in which the opening is closed by the tray cover, the transferred sheet toward the downstream side in the sheet transferring direction, wherein the tray cover is configured to be pivotable between (i) an open position at which the tray cover opens the opening and (ii) a close position at which the tray cover closes the opening, about a first pivotal axis that is located on a downstream side of the tray cover in the sheet transferring direction, wherein the pressing member extends on a downstream side of the first pivotal axis in the sheet transferring direction, wherein, while the tray cover is moved from the closed position to the open position, the pressing member translates from a pressing position at which the pressing member presses the sheet accommodated in the tray, to a distant position at which the pressing member is distant from the sheet accommodated in the tray, and wherein the pressing member is configured to rotate relative to the tray cover about a second pivotal axis disposed on the tray cover.

2. The sheet accommodating device according to claim 1, wherein the pressing member includes a contact portion which contacts with the sheet accommodated in the tray, and wherein the guide portion is formed so as to be continuous to the contact portion and curved in a direction away from the sheet accommodated in the tray.

3. The sheet accommodating device according to claim 1, further comprising:

a side wall provided so as to be erected in the tray and so as to extend along an edge portion of the sheet accommodated in the tray which extends in the sheet transferring direction; and a cam formed in the side wall and configured to regulate a position of the pressing member relative to the sheet accommodated in the tray, wherein the pressing member is movable along the cam between (a) a position at which the pressing member presses the sheet accommodated in the tray in the state in which the opening is closed by the tray cover and (b) a position at which the pressing member is distant from the sheet accommodated in the tray in a state in which the opening is opened by the tray cover.

4. The sheet accommodating device according to claim 3, wherein the pressing member is provided so as to be pivotable relative to the tray cover, and wherein the pressing member is movable along the cam in a direction away from the sheet accommodated in the tray while being pivoted relative to the tray cover in accordance that the tray cover is pivoted relative to the tray in a direction in which the opening is opened.

5. An image recording apparatus comprising:

the sheet accommodating device according to claim 1;

a sheet-supply roller configured to supply the sheet accommodated in the tray of the sheet accommodating device while contacting with the sheet; and a recording device configured to record an image on the sheet supplied by the sheet-supply roller, wherein the guide portion guides the sheet supplied by the sheet-supply roller toward the recording device.

6. The image recording apparatus according to claim 5, wherein the pressing member has a cutout through which the sheet-supply roller contacts with the sheet, and wherein a plurality of guide portions each as the guide portion guide the sheet supplied by the sheet-supply roller toward the recording device at positions respectively located on opposite sides of the cutout in a widthwise direction of the sheet.

7. The image recording apparatus according to claim 5, further comprising a sheet retransferring mechanism configured to retransfer, toward the sheet-supply roller, a recorded sheet whose front surface has been subjected to image recording by the recording device, wherein the pressing member is disposed between the sheet retransferring mechanism and the sheet-supply roller, and backs up the recorded sheet transferred toward the sheet-supply roller by the sheet retransferring mechanism, and wherein the guide portion reguides the recorded sheet toward the recording device.

8. The image recording apparatus according to claim 7, wherein the sheet retransferring mechanism transfers the recorded sheet such that the front surface thereof is brought into contact with the sheet-supply roller, and wherein the pressing member backs up the recorded sheet at a back surface thereof.

9. The image recording apparatus according to claim 5, configured to record images on respective front and back surfaces of the sheet, wherein the image recording apparatus further comprising:

a pair of side guides each functioning as the side wall and provided so as to be erected in the tray, so as to extend along edge portions of the sheet accommodated in the tray which extend in the sheet transferring direction, and so as to respectively hold the edge portions of the sheet; and a sheet retransferring mechanism configured to retransfer, toward the sheet-supply roller, a recorded sheet whose front surface has been subjected to the image recording by the recording device, wherein the pair of side guides respectively include a pair of side guide portions which respectively contact with the edge portions of the recorded sheet transferred toward the sheet-supply roller by the sheet retransferring mechanism, and between which the recorded sheet is transferred through, and wherein the pair of side guide portions are configured such that a distance therebetween in a widthwise direction of the sheet is larger than a width of the sheet at respective parts of the pair of side guide portions in the sheet transferring direction and is gradually decreased from the respective parts of the pair of side guide portions toward the sheet-supply roller.

10. The image recording apparatus according to claim 9, further comprising a backup member including the pressing member, wherein the backup member backs up the recorded sheet transferred toward the sheet-supply roller by the sheet retransferring mechanism, while being held in contact with a surface of the recorded sheet opposite to the other surface thereof which is brought into contact with the sheet-supply roller, and wherein portions of the backup member which are respectively adjacent to the pair of side guide portions are cut out so as to form a pair of cutouts.

11. The image recording apparatus according to claim 9, further comprising a controller configured to execute a control for transferring the recorded sheet, wherein the sheet retransferring mechanism includes a pair of rollers which are rotated in opposite directions and which transfer the recorded sheet while nipping, and wherein the controller controls the sheet retransferring mechanism such that while the recorded sheet is transferred toward the sheet-supply roller by rotating the pair of rollers in one of the opposite directions before a leading end of the recorded sheet has reached the sheet-supply roller, and after the recorded sheet is transferred by a predetermined distance by rotating the pair of rollers in the other of the opposite directions, the recorded sheet is transferred into between the pair of side guide portions by rotating the pair of rollers in the one of the opposite directions again.

12. The image recording apparatus according to claim 9, wherein respective side faces of the pair of side guide portions which face to each other and which contact the transferred recorded sheet are inclined relative to each other such that where a plurality of recording sheets are accommodated in the tray, the side faces become nearer to each other from an uppermost one of the plurality of recording sheets toward a lowermost one of the plurality of recording sheets.

13. The image recording apparatus according to claim 9, wherein the distance between the pair of side guide portions is gradually decreased toward the sheet-supply roller to be equal to a distance between the pair of side guides on an upstream side of the sheet-supply roller in the sheet transferring direction.

14. The image recording apparatus according to claim 13, wherein the pair of side guides are adjustable in a distance therebetween.

* * * * *